US007188609B2

(12) United States Patent
Watanabe et al.

(10) Patent No.: US 7,188,609 B2
(45) Date of Patent: Mar. 13, 2007

(54) FUEL DELIVERY PIPE

(75) Inventors: Eiji Watanabe, Shizuoka (JP); Koichi Hayashi, Shizuoka (JP); Shoichiro Usui, Shizuoka (JP)

(73) Assignee: Usui Kokusai Sangyo Kaisha, Ltd., Shizuoka (JP)

( * ) Notice: Subject to any disclaimer, the term of this patent is extended or adjusted under 35 U.S.C. 154(b) by 0 days.

(21) Appl. No.: 11/194,485

(22) Filed: Aug. 2, 2005

(65) Prior Publication Data

US 2006/0027214 A1 Feb. 9, 2006

(30) Foreign Application Priority Data

Aug. 3, 2004 (JP) ..... P.2004-226693

(51) Int. Cl.
*F02M 69/46* (2006.01)
*F02M 69/50* (2006.01)

(52) U.S. Cl. ..... 123/456; 123/468

(58) Field of Classification Search ..... 123/456, 123/468, 469, 470, 472, 447
See application file for complete search history.

(56) References Cited

U.S. PATENT DOCUMENTS 3,412,718 A * 11/1968 Long ..... 123/468
3,507,263 A * 4/1970 Long ..... 123/455
3,581,723 A * 6/1971 Scholl ..... 123/492
4,142,497 A * 3/1979 Long ..... 123/456
5,765,534 A * 6/1998 Brown et al. ..... 123/470
6,135,092 A * 10/2000 Schaenzer et al. ..... 123/456
6,491,025 B2 * 12/2002 Ferry et al. ..... 123/456
6,805,105 B2 * 10/2004 Kato et al. ..... 123/514
2006/0144368 A1 * 7/2006 Knight et al. ..... 123/447

FOREIGN PATENT DOCUMENTS

JP 60-240867 11/1985
JP 10-331743 12/1998
JP 11-2164 1/1999
JP 11-37380 2/1999
JP 2000-320422 11/2000
JP 2000-329030 11/2000
JP 2000-329031 11/2000

* cited by examiner

*Primary Examiner*—Mahmoud Gimie
(74) *Attorney, Agent, or Firm*—Morgan, Lewis & Bockius LLP

(57) ABSTRACT

An inlet port 16 communicating with the interior of a fuel delivery pipe body 10 to introduce fuel is made open in a center of a tubular joint 11 having a smaller diameter than an inside diameter of a holder portion 15 of an injector 32 connected to a respective pipe end portion 25, and a length from a center of this inlet port 16 to the pipe end portion 25 is set to 30 to 1000 mm, to thereby form the tubular joint 11. The tubular joint 11 and the fuel delivery pipe body 10 are fixed such that the inlet port 16 of this tubular joint 11 is communicatable with the interior of the fuel delivery pipe body 10.

11 Claims, 23 Drawing Sheets

FUEL DELIVERY PIPE

The present application claims foreign priority based on Japanese Patent Application No. 2004-226693, filed on Aug. 3, 2004, the contents of which is incorporated herein by reference in its entirety, and concurrently with the filing of this patent application.

BACKGROUND OF THE INVENTION

The present invention relates to a fuel delivery pipe for supplying fuel supplied from a fuel booster pump of an electronic fuel injection type automotive engine to respective intake passages of the engine through an injector, and is aimed at reducing the radiation noise generated during fuel injection from the injector.

Conventionally, fuel delivery pipes are known in which a plurality of injectors are provided to supply fuel such as gasoline to a plurality of cylinders of the engine. In this fuel delivery pipe, fuel introduced from a fuel tank through underfloor piping is sequentially injected into a plurality of intake pipes or cylinders of the engine from the plurality of injectors, and this fuel is mixed with air. As this air-fuel mixture is burned, an output of the engine is produced.

These fuel delivery pipes include a return type which has a circuit whereby in a case where fuel has been excessively supplied from the fuel tank, that excess fuel is returned to the fuel tank by a pressure regulator, and a returnless type which does not have the circuit for returning the excess fuel to the fuel tank. Recently, returnless type fuel delivery pipes are frequently used for the purposes of cost reduction and the prevention of a temperature rise of the gasoline in the fuel tank.

Since this returnless type fuel delivery pipe does not have the piping for returning the excess fuel to the fuel tank, if the interior of the fuel delivery pipe is decompressed by the fuel injection from the injectors into the intake pipes or cylinders of the engine, pressure waves which occur due to this sharp decompression and the stopping of the fuel injection causes pressure pulsation in the interior of the fuel delivery pipe. After this pressure pulsation is propagated from the fuel delivery pipe and a connection pipe connected to this fuel delivery pipe to the fuel tank side, the pressure pulsation is reversed by a pressure regulation valve in the fuel tank and is returned, and is propagated to the fuel delivery pipe through the connection pipe. The fuel delivery pipe is provided with a plurality of injectors, and the plurality of injectors sequentially effect the injection of fuel and generate pressure pulsation. As a result, this pressure pulsation is propagated to the vehicle compartment as noise through clips retaining the underfloor piping to underneath the floor, and this noise imparts an unpleasant feeling to the driver and passengers.

Conventionally, as methods for controlling drawbacks due to such pressure pulsation, a pulsation damper with a rubber diaphragm incorporated therein is disposed in the returnless type fuel delivery pipe to absorb the generated pressure pulsation energy by this pulsation damper, and the underfloor piping which is laid underneath the floor from the fuel delivery pipe to the fuel tank side is fixed to underneath the floor via vibration absorbing clips. Thus, vibrations generated in the fuel delivery pipe or the underfloor piping up to the tank are absorbed. These methods are relatively effective and have effects in controlling the drawbacks due to the generation of the pressure pulsation.

In addition, fuel delivery pipes having a pulsation absorbing function capable of allowing the fuel delivery pipe to absorb the pressure pulsation have been proposed for the purpose of reducing the pressure pulsation, as in the inventions shown in patent documents 1 to 6. In these fuel delivery pipes having the pulsation absorbing function, a flexible absorbing surface is formed on an outer wall of the fuel delivery pipe, and as the absorbing surface is flexurally deformed by being subjected to the pressure generated in consequence of the fuel injection, the absorbing surface absorbs and reduces the pressure pulsation. It thereby becomes possible to prevent the occurrence of abnormal noise due to the vibration of the fuel delivery pipe and other parts.

However, the pulsation damper and the vibration absorbing clips are expensive, and the number of parts increases, entailing a higher cost. Further, a new problem has occurred in the securing of the installation space. On the other hand, in the conventional techniques shown in patent documents 1 to 6, although there is an effect in absorbing the pressure pulsation, there has been a problem in that there can occur the trouble that noise on the high-frequency side of not less than several kilohertz such as clattering noise is generated when an injector spool is seated onto a valve seat or the like as the injector is opened and closed during the fuel injection, and this noise is amplified by the absorbing surface and is radiated to the outside.

In a patent document 7, to reduce this radiation noise, a method is used in which a bead is provided on a wall surface opposing a wall surface where the injector is disposed, and a circular pipe is joined to the opposing wall surface, thereby increasing the surface rigidity of the opposing wall surface. Since the surface rigidity is thus high, in the case where the pressure pulsation has occurred inside the fuel delivery pipe, the fuel delivery pipe is prevented from being deflected greatly by this pulsation, suppressing the radiation of the high-frequency noise to a low level.

[Patent Document 1] JP-A-2000-329030
[Patent Document 2] JP-A-2000-320422
[Patent Document 3] JP-A-2000-329031
[Patent Document 4] JP-A-Hei11-37380
[Patent Document 5] JP-A-Hei11-2164
[Patent Document 6] JP-A-Sho60-240867
[Patent Document 7] JP-A-Hei10-331743

However, according to the method in which a bead is provided on the wall surface, it is technically difficult to make adjustment such that the high-frequency side noise will not be radiated while being provided with the flexibility capable of suppressing the pressure pulsation of a fluid. In addition, if a circular pipe is joined to the flat wall surface, the mutual contact becomes linear contact, and joining stability is insufficient, so that there has been a possibility that the high-frequency noise reverberates inside the circular pipe.

SUMMARY OF THE INVENTION

Accordingly, an object of the invention is to provide a fuel delivery pipe which makes it possible to control the frequency of the pressure fluctuation in the flow route of fuel in conjunction with fuel injection from the injector, and which is capable of suppressing the direct transmission to the fuel delivery pipe body of high-frequency noise such as clattering noise generated when an injector spool is seated onto a valve seat or the like, thereby making it possible to suppress to a small level the radiation of the high-frequency noise to the fuel delivery pipe body and to the outside.

To attain the above object, according to the present invention, there is provided with a fuel delivery pipe, including: a fuel delivery pipe body, a tubular joint, an injector, and a holder portion, wherein the tubular joint is provided with an inlet port communicating with the interior of a fuel delivery pipe body to introduce fuel made open in a center of the tubular joint having a smaller diameter than an inside diameter of the holder portion of the injector connected to both pipe end portion, a length from a center of the inlet port to the pipe end portion for connecting the holder portion of the injector is set to 30 to 1000 mm, to form the tubular joint, and the tubular joint and the fuel delivery pipe body are fixed such that the inlet port of the tubular joint is communicatable with the interior of the fuel delivery pipe body.

In addition, the fuel delivery pipe body may be constructed such that it has an outlet port for fuel which is open in its wall surface, the tubular joint is disposed in contact with an outer surface of the fuel delivery pipe body in such a manner as to allow the outlet port and the inlet port of the tubular joint to communicate with each other, and an outer periphery of the communicating portion is fixed by welding or brazing.

In addition, the fuel delivery pipe body may be constructed such that the it has an outlet port for fuel which is open in its wall surface, the outlet port and the inlet port of the tubular joint are connected via a connection pipe provided on an outer surface of the fuel delivery pipe body, and an outer periphery of the communicating portion is fixed by welding or brazing.

In addition, the fuel delivery pipe body may have the tubular joint inserted and disposed in its interior so that the inlet port of the joint and the interior of the fuel delivery pipe body communicate with each other, both pipe end portions of the tubular joint are caused to project to the outside from projection holes opened in a wall surface of the fuel delivery pipe body, the holder portion of the injector is provided at each of the projecting portions, and an outer periphery of each of the projecting portions is fixed to the fuel delivery pipe body by welding or brazing.

In addition, the tubular joint may be provided with one or a plurality of bent portions between the pipe end portion and the position where the inlet port is formed.

In addition, the fuel delivery pipe body may include a fixing member which is capable of suppressing the deformation of the fuel delivery pipe body and which is connected and fixed to the fuel delivery pipe body to straddle an outer surface of the tubular joint.

In addition, the fuel delivery pipe body and the tubular joint may be fixed by welding or brazing with the interposition of an interposed member capable of suppressing the deformation of the fuel delivery pipe body, and the outlet port of the fuel delivery pipe body and the inlet port of the tubular joint may be communicated through a through hole provided in the interposed member.

In addition, the interposed member is a bracket connected and fixed to an outer surface of the outlet port in the fuel delivery pipe body, a through hole may be provided in the bracket in correspondence with the outlet port of the fuel delivery pipe body, the tubular joint may be contacted with and fixed to the bracket by welding or brazing, and the outlet port of the fuel delivery pipe body and the inlet port of the tubular joint may be communicated through the through hole provided in the bracket.

In addition, the connecting portion of the tubular joint for connection to the fuel delivery pipe body may have a shape corresponding to that of the wall surface of the fuel delivery pipe body, and the tubular joint and the fuel delivery pipe body may be connected by surface contact.

In addition, the tubular joint may be formed integrally with the holder portion.

In addition, the tubular joint may be formed separately from the holder portion.

The fuel delivery pipe in accordance with the invention is constructed as described above, in the pressure pulsation caused by the fuel injection by the injector, which constitutes the problem of the radiation noise, since the length of a fuel flow member from the tip of the injector to the fuel delivery pipe body is elongated by the interposition of the tubular joint between the holder portion of the injector and the fuel delivery pipe body, the natural pulsation frequency of this flow member and the natural resonance frequency of the fuel delivery pipe body can be made different. Accordingly, it becomes possible to suppress the resonance of the fuel delivery pipe body due to the pressure pulsation from the injector side. Further, the mechanical vibrations due to the operation of the injector, which constitutes a problem in the radiation noise separately from the pressure pulsation, can be absorbed as the tubular joint which is formed to be elongated undergoes flexural deformation, making it possible to suppress the propagation of the mechanical vibrations to the fuel delivery pipe body. Accordingly, the high-frequency noise of not less than several kilohertz such as clattering noise, which is generated when the injector spool is seated onto the valve seat or the like after fuel injection, is prevented from being amplified by the fuel delivery pipe body, thereby making it possible to suppress the occurrence of the radiation noise to the outside to a small level.

DETAILED DESCRIPTION OF THE PREFERRED EMBODIMENTS

Figure 1:
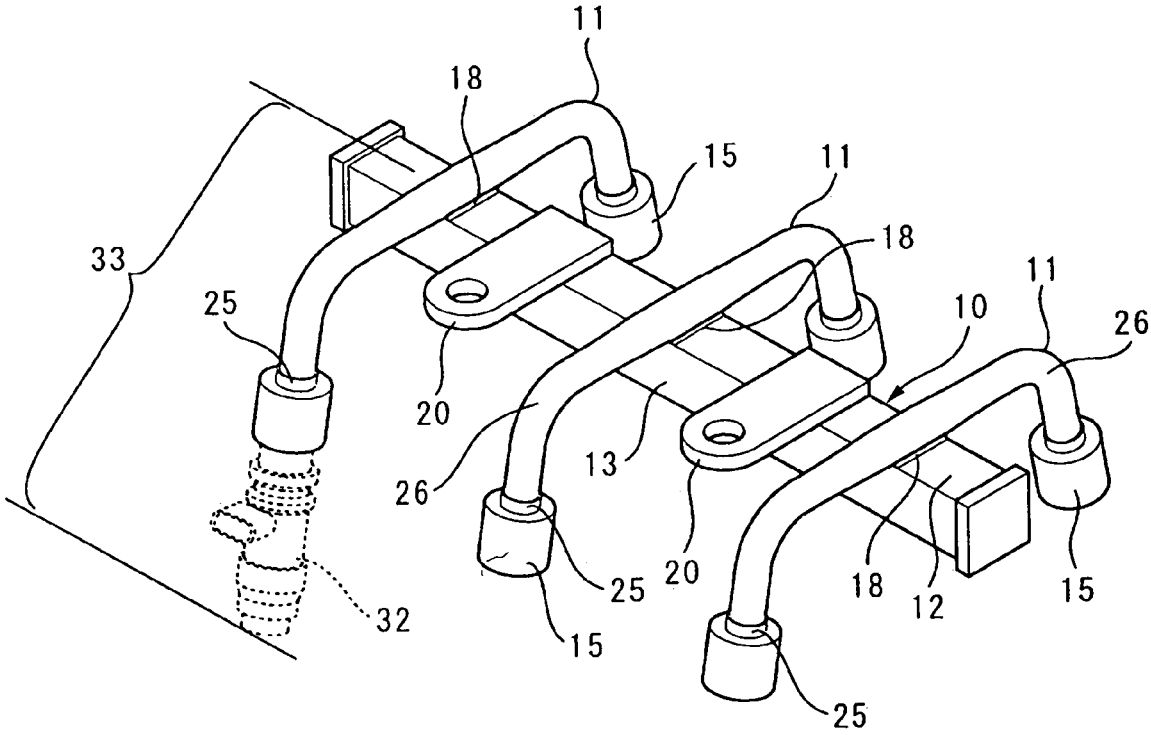
FIG. 1 is a perspective view of a fuel delivery pipe in accordance with a first embodiment of the invention.

The inside diameter of the tubular joint is formed to be smaller than the inside diameter of the holder portion of each of the injectors respectively connected to both pipe end portions of the tubular joint. Since the mainstream product of the holder portion has an inside diameter of approximately 11 mm to 13 mm, it is preferable to set the inside diameter of the tubular joint to 3.36 mm, more preferably 6.6 mm or thereabouts. In addition, the inside diameter of the tubular joint may be formed uniformly from one pipe end portion to the other pipe end portion, or the connection pipe may be formed in a flat or other similar shape to enhance the stability of connection to the fuel delivery pipe body. In addition, the inside diameter of a portion of the tubular joint may be made small to provide a constricted portion so as to damp the pressure pulsation of the fuel due to the water hammer phenomenon. In addition, the length from the center of the inlet port provided in the center of the tubular joint to the pipe end portion for connecting the holder portion of the injector is set to 30 mm to 1000 mm.

In addition, conventionally, there has occurred the trouble that noise on the high-frequency side of not less than several kilohertz such as clattering noise, which is generated when the injector spool is seated onto the valve seat or the like, is amplified by the speaker phenomenon of the wall surface of the fuel delivery pipe body and is radiated to the outside. The cause of the generation of this radiation noise is conceivably due to the following two factors: the excitation of the fuel delivery pipe body by the pressure pulsation during fuel injection from the injector, and the propagation to the fuel delivery pipe body of the mechanical vibrations due to the operation of the injector through the members between the injector and the fuel delivery pipe body. In the invention, the distance between the fuel inlet port and the injector is made long by connecting the holder portion and the fuel delivery pipe body by the tubular joint, thereby making it possible to effectively suppress the generation of the radiation noise, as will be described later.

First, as a mechanism of the amplification of the radiation noise due to the excitation of the fuel delivery pipe body caused by the pressure pulsation, in a case where the natural pulsation frequency of the fuel flow member including the inlet port and the tubular joint connected thereto via the holder is close to the natural resonance frequency of the fuel delivery pipe body, the wall surfaces of the fuel delivery pipe body resonate due to the pressure fluctuation of the internal fluid caused by the fuel injection by the injector, producing large radiation noise.

To overcome this, the method of changing the natural pulsation frequency of the aforementioned fuel flow member is effective. As for the natural pulsation frequency of this fuel flow member, the effect of the length of that fuel flow member, i.e., from the tip of the injector to the fuel inlet port through the holder portion and the tubular joint, is large. This is deeply related to the air column vibration mode of the interior of the fuel flow member. An air column vibration mode which has the condition of an air column having one end closed and the other end open applies to this air column vibration mode, and can be expressed by the formula: f=n□/41 (f: frequency, n: degree of the air column vibration mode, □: sound velocity of the fluid, 1: length of the air column from the tip of the injector to the fuel delivery pipe body). The factor which exerts the greatest influence is the frequency at the time when n=1. Thus, it becomes possible to suppress the resonance of the fuel delivery pipe body by controlling the frequency in the air column vibration mode by adjusting the air column length from the tip of the injector to the fuel delivery pipe body, i.e., by making the length of the fuel flow member elongated by interposing the tubular joint between the holder portion of the injector and the fuel delivery pipe body, thereby making it possible to reduce the radiation noise.

In addition, as described above, the aforementioned air column vibration mode should be considered by the length of the fuel flow member, i.e., the combined length from the pipe end portion of the tubular joint connecting the holder portion to the inlet port communicating with the interior of the fuel delivery pipe body, including the length of the injector itself and the holder portion. Here, a standard fuel delivery pipe body made of STKM or stainless steel, which is generally in use, has a pipe length of 300 mm, with its cross-sectional shape in the orthogonal direction to the pipe axis being elliptical with a long axis of 34 mm and a short axis of 10.2 mm, and has an absorbing wall surface with a wall thickness of 1.2 mm. The natural resonance frequency of such a fuel delivery pipe body is approximately 4 kHz. Accordingly, by converting the air column vibration mode frequency of the fuel flow member to a low frequency different from 4 kHz, it becomes possible to suppress the generation of the radiation noise due to resonance. If the total length from the tip of the injector to the inlet port is assumed to be 90 mm, the frequency in the air column vibration mode becomes 3 kHz, and if it is assumed to be 120 mm, the frequency in the air column vibration mode becomes 2 kHz. Since the injector has a length of 60 mm or thereabouts in terms of its function, by setting the length from the pipe end portion of the tubular joint to the center of the inlet port to 30 mm to 1000 mm, it becomes possible to change the natural pulsation frequency of the fuel flow member and avoid the frequency of the fuel delivery pipe body which constitutes a problem of the radiation noise in practical use.

Furthermore, in a case where the holder portions are respectively connected to both pipe end portions, and the tubular joint is fixed to the outer surface of the fuel delivery pipe body bilaterally symmetrically about the inlet port which is open in the center of this tubular joint, this fixed portion serves as a node of vibration due to the pressure pulsation of the tubular joint. For this reason, the pressure pulsation on the injector side is made difficult to propagate to the fuel delivery pipe body side, thereby making it possible to further enhance the effect of suppressing the radiation noise.

In addition, in the case of the fuel delivery pipe in which the mechanical vibrations due to the operation of the injector are propagated to the fuel delivery pipe body, with the conventional technique or the like in which the holder portion is directly fixed to the fuel delivery pipe body, the mechanical vibrations of the injector are not damped, and are propagated to the fuel delivery pipe body through the surface of the holder portion made of a metallic material.

In the invention, however, since the holder portion of the injector is connected to the fuel delivery pipe body via the elongated tubular joint, as compared with the case where the holder portion is directly connected, the rigidity between the holder portion and the fuel delivery pipe body becomes low. For this reason, if mechanical vibrations occur due to the operation of the injector, the tubular joint is easily flexurally deformed in response to the vibrations, thereby absorbing the mechanical vibrations. As a result, the mechanical vibrations of the injector are made difficult to propagate to the fuel delivery pipe body, so that it becomes possible to prevent the amplification of the high-frequency noise due to the wall surfaces of the fuel delivery pipe body, making it possible to suppress the generation of the radiation noise. In addition, the vibration absorbing effect based on this tubular joint can be further enhanced by providing bent portions in the tubular joint.

Accordingly, in the invention, the high-frequency noise of not less than several kilohertz such as clattering noise, which is generated when the injector spool is seated onto the valve seat or the like after fuel injection, is prevented from being amplified by the wall surfaces of the fuel delivery pipe body, thereby making it possible to suppress the radiation of the high-frequency noise to the outside to a small level.

In addition, the length of the tubular joint suffices if it is 30 mm or more, if it is shorter than 30 mm, the frequency in the air column vibration mode becomes high and becomes close to the natural resonance frequency of the fuel delivery pipe body, so that the malfunctions of resonance and the like are not overcome, and the effect of preventing the radiation of the high-frequency noise to the outside is low. In addition, the longer the length, the greater the difference between the natural pulsation frequency of the injector and the natural resonance frequency of the fuel delivery pipe body becomes, making it possible to enhance the effect of suppressing the radiation noise. However, in the light of installation in the vehicle body, if the length if longer than 1000 mm, even in the case of a horizontally opposed type engine, which will be described later, the fuel delivery pipe becomes bulky, so that the layout feature at the time of installation onto the vehicle body declines. Further, the material cost and the like become high and the fuel delivery pipe becomes costly despite the fact there is not much difference in the effect of reduction of the radiation noise.

In the case of a V-type engine, in a case where the inclusion angle of the tubular joint bent in the v-shape is made narrow, the length of this tubular joint becomes 100 mm or thereabouts. In the case where the inclusion angle is made wide, the length of the tubular joint becomes 200 mm or thereabouts. In addition, in the case of the horizontally opposed-type engine in which the tubular joint is connected to the fuel delivery pipe body orthogonally to the direction its pipe axis, the tubular joint become more elongated and assumes a length of 50 to 1000 mm or thereabouts.

[1st Embodiment]

Hereafter, referring to FIGS. 1 and 2, a detailed description will be given of a first embodiment of the fuel delivery pipe in accordance with the invention. Reference numeral 10 denotes a fuel delivery pipe body whose cross-sectional shape perpendicular to the pipe axis is square. A fuel inlet pipe (not shown) is connected to one end of this fuel delivery pipe body 10, and this fuel inlet pipe is joined to a fuel tank (not shown) through underfloor piping (not shown). Fuel in this fuel tank is transferred to the fuel inlet pipe through the underfloor piping, and flows into the fuel delivery pipe body 10 from the fuel inlet pipe. The fuel in the fuel delivery pipe body 10 is injected into intake pipes and cylinders from injectors 32 respectively connected to tubular joints 11 which will be described later.

The above-described fuel delivery pipe body 10 has four walls including upper and lower walls 12 and both side walls 13, which are elongated in the direction of the pipe axis. The fuel delivery pipe body 10 has three fuel outlet ports 14 which are open in the surface of one of the upper and lower wall 12. Meanwhile, the tubular joint 11 for supplying the fuel from the fuel delivery pipe body 10 to the injectors 32 has a pair of holder portions 15 respectively provided at both pipe end portions 25 for connecting the injectors 32. The inside diameter of the tubular joint 11 is formed to be smaller than the inside diameter of this holder portion 15. In addition, the holder portion 15 may be formed integrally with the main body of the tubular joint 11, or may be formed separately and may be fixed by welding or brazing to the main body of the tubular joint 11, or may be formed so as to be connected by being threadedly secured.

In addition, the tubular joint 11 has a fuel introducing inlet port 16 which is open in a center of its side surface, and both side portions each located between this inlet port 16 and the respective pipe end portion 25 are bent substantially orthogonally to provide bent portions 26 on both sides, so that the tubular joint 11 in a side view is formed in a U-shape. The side surface of the tubular joint 11 provided with the inlet port 16 is disposed in contact with the outer surface of the upper or lower wall 12 of the fuel delivery pipe body 10 where the outlet port 14 is provided, such that their respective pipe axes are perpendicular to each other, thereby allowing the outlet port 14 and the inlet port 16 to communicate with each other. A flow path 17 for the fuel from the fuel delivery pipe body 10 to the tubular joint 11 is formed by this communication. The fuel delivery pipe body 10 and the tubular joint 11 are fixed by welding or brazing at a joint portion in the peripheries of this flow path 17, thereby connecting the fuel delivery pipe body 10 and the tubular joint 11, as shown in FIG. 2.

By virtue of such arrangement, the contacting upper or lower wall 12 of the fuel delivery pipe body 10 and the wall surface of the tubular joint 11 can be disposed in parallel, so that the contact area of the connecting portion can be increased remarkably. Further, the contact area between the fuel delivery pipe body 10 and the tubular joint 11 can be further increased by fillets 18 of the melted metallic material or brazing filler metal, and the connection strength becomes firm, thereby making it possible to enhance the connection stability.

Figure 2:
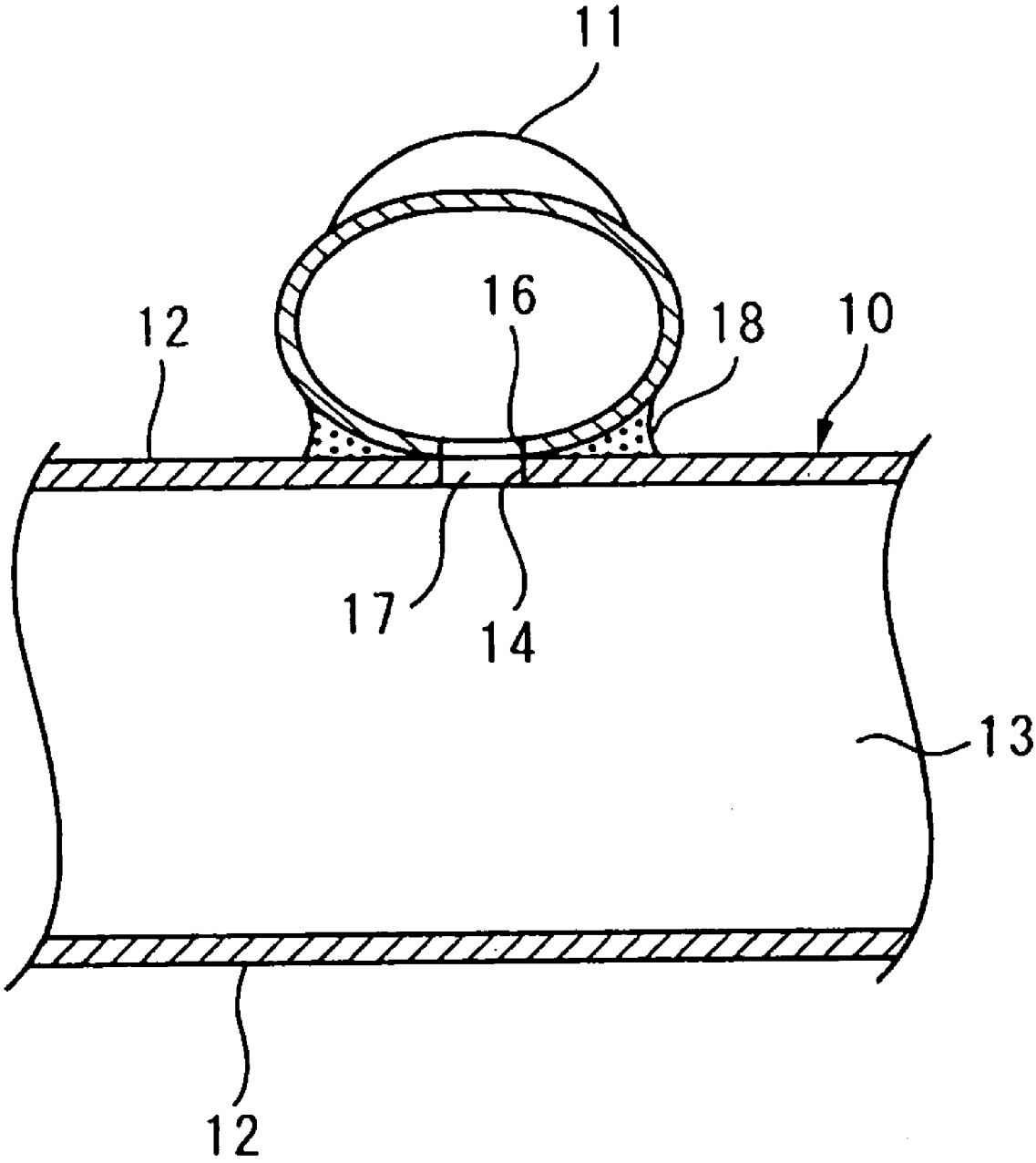
FIG. 2 is a cross-sectional view, taken in an orthogonal direction to a pipe axis of a tubular joint, of a connecting portion between a fuel delivery pipe body and the tubular joint in the first embodiment.

It should be noted that although the tubular joint 11 is circular in its cross-sectional shape, a portion in the vicinity of the inlet port 16 where the fuel delivery pipe body 10 is connected and fixed is formed in a flat shape such that its cross-sectional shape becomes elliptical, as shown in FIG. 2, making it possible to secure a greater contact area between the tubular joint 11 and the fuel delivery pipe body 10. Further, brackets 20 are connected and fixed to the fuel delivery pipe body 10 so as to connect and fix the fuel delivery pipe body 10 to the main body of the engine.

Figure 3:
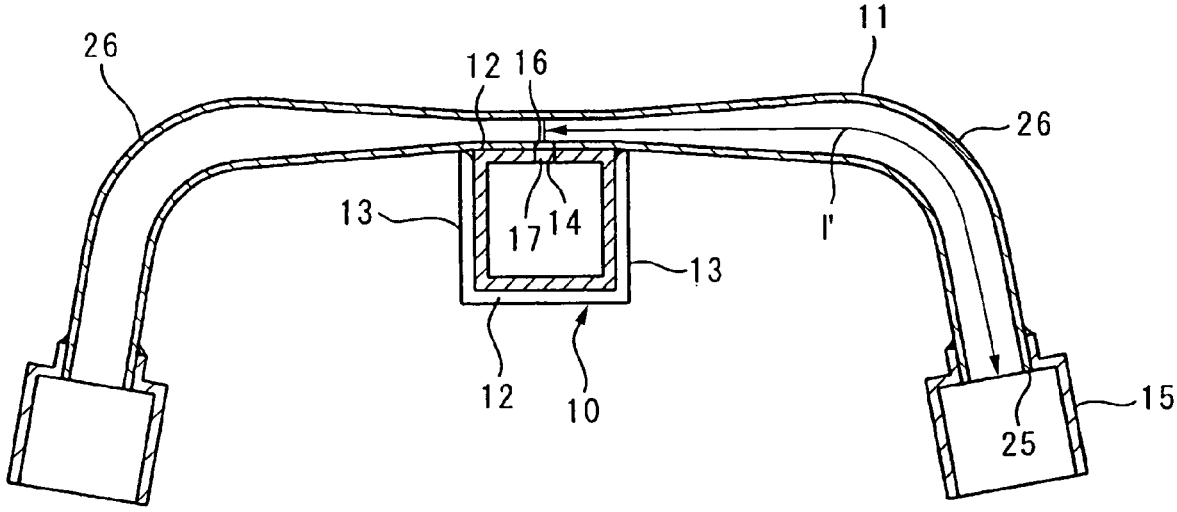
FIG. 3 is a cross-sectional view, taken in a parallel direction to the pipe axis of the tubular joint, of the connecting portion between the fuel delivery pipe body and the tubular joint in the first embodiment.

In addition, as for the tubular joint 11, the length (l' shown in FIG. 3) from the center of the inlet port 16 to the pipe end portion 25 for connection to the holder portion 15 via the bent portion 26 is formed in the range of 30 mm to 1000 mm. In the so-called horizontally opposed type in which the fuel delivery pipe body 10 and the tubular joint 11 are connected perpendicularly to each other as in this first embodiment, even if the length of the tubular joint 11 is formed to be long in the range of 500 to 1000 mm, the layout feature does not aggravate. In this specification, portions extending from the center of the inlet port 16 to the pipe end portion 25 of the tubular joint 11 and even up to a distal end of the injector 32 including the holder portion 15 are defined as a fuel flow member 33 for fuel concerning the pulsation frequency inherent to the pressure pulsation on the injector 32 side.

In the fuel delivery pipe formed as described above, when fuel is introduced into the fuel delivery pipe body 10 from the fuel inlet pipe, the fuel flows out into the tubular joint 11 through the flow path 17, flows through this tubular joint 11, and is injected into the intake pipe or the cylinder from the injector 32 connected to the holder portion 15. Conventionally, owing to the excitation of the fuel delivery pipe body 10 due to the pressure pulsation of the injector 32 and the propagation of mechanical vibrations due to the operation of the injector 32, there can occur the trouble that noise on the high-frequency side of not less than several kilohertz such as clattering noise is generated when a spool of the injector 32 is seated onto a valve seat or the like, and this noise is amplified by the wall surface of the fuel delivery pipe body 10, so that large radiation noise is radiated to the outside.

However, with the fuel delivery pipe body of the invention, the overall length of the fuel flow member 33 is elongated by the interposition of the elongated tubular joint 11 between the fuel delivery pipe body 10 and the holder portion 15 for connecting the injector 32. Accordingly, it becomes possible to adjust the natural pulsation frequency of the fuel flow member 33 to a low frequency different from the natural resonance frequency of the fuel delivery pipe body 10. As a result, the fuel delivery pipe body 10 can be suppressed from resonating to the pressure pulsation of the injector 32 which is propagated through the fuel inside the fuel flow member 33, thereby making it possible to suppress the generation of the radiation noise to a low level.

Furthermore, in the first embodiment, the pair of holder portions 15 are respectively provided on both pipe end portions 25 of the tubular joint 11, and the tubular joint 11 is fixed to an outer surface of the fuel delivery pipe body 10 symmetrically about the inlet port 16 which is open in the center of the tubular joint 11. Accordingly, when the pressure pulsation has occurred in consequence of the fuel injection from the injector 32 connected to the holder portion 15 at the pipe end portion 25, the connecting portion between the tubular joint 11 and the fuel delivery pipe body 10 serves as a node of vibration caused by this pressure pulsation. Therefore, the pressure pulsation becomes difficult to propagate to the fuel delivery pipe body 10 through the connecting portion.

Meanwhile, the mechanical vibrations due to the operation of the injector 32, which constitutes another problem of the radiation noise separately from the pressure pulsation, are damped as the elongated tubular joint 11 is easily flexurally deformed. Hence, these mechanical vibrations are difficult to propagate to the fuel delivery pipe body 10. With the tubular joint 11 in the first embodiment, in particular, the resilient deformability of the tubular joint 11 is increased by providing the bent portions 26, thereby making it possible to enhance the effect of damping the mechanical vibrations.

Thus, in the first embodiment of the invention and the embodiments that follow, the fuel flow member 33 is elongated by providing the tubular joint 11 so as to make adjustment to a lower frequency in the air column vibration mode. As a result, the noise on the high-frequency side of not less than several kilohertz such as clattering noise, which is generated when the spool of the injector 32 is seated onto the valve seat or the like, is prevented from being amplified by the wall surface of the fuel delivery pipe body 10, thereby making it possible to suppress the radiation of the high-frequency noise to the outside.

In addition, in the case where the wall surface of the tubular joint 11 is fixed to the outer surface of the fuel delivery pipe body 10 in contact therewith as in the first embodiment, it is possible to increase the durability of the fuel delivery pipe. Its basic principle is as follows. A strong deforming force is applied to the upper and lower walls 12 and both side walls 13 owing to the pressure pulsation and the like caused by the pulsation of fuel injection and the flow of fuel inside the fuel delivery pipe body 10, and a strong stress is applied to the connecting portion between the upper or lower wall 12 and the tubular joint 11. However, since the contacting upper or lower wall 12 and the wall surface of the tubular joint 11 are disposed in parallel and are made to contact each other at the connecting portion with a wide contact area through the fillets 18 by welding or brazing, the flow stress is dispersed and is prevented from being concentrated partially. Accordingly, it is possible to prevent malfunctions such as the occurrence of a crack in the fillet 18 or its vicinity, and satisfactorily maintain the sealability between the fuel delivery pipe body 10 and the tubular joint 11 over long periods of time, thereby making it possible to enhance the effect of preventing fuel leakage and the like. In consequence, it is possible to maintain satisfactory fuel injection from the injector 32, so that it is possible to obtain a high-quality fuel delivery pipe excelling in durability.

[2nd Embodiment]

Figure 4:
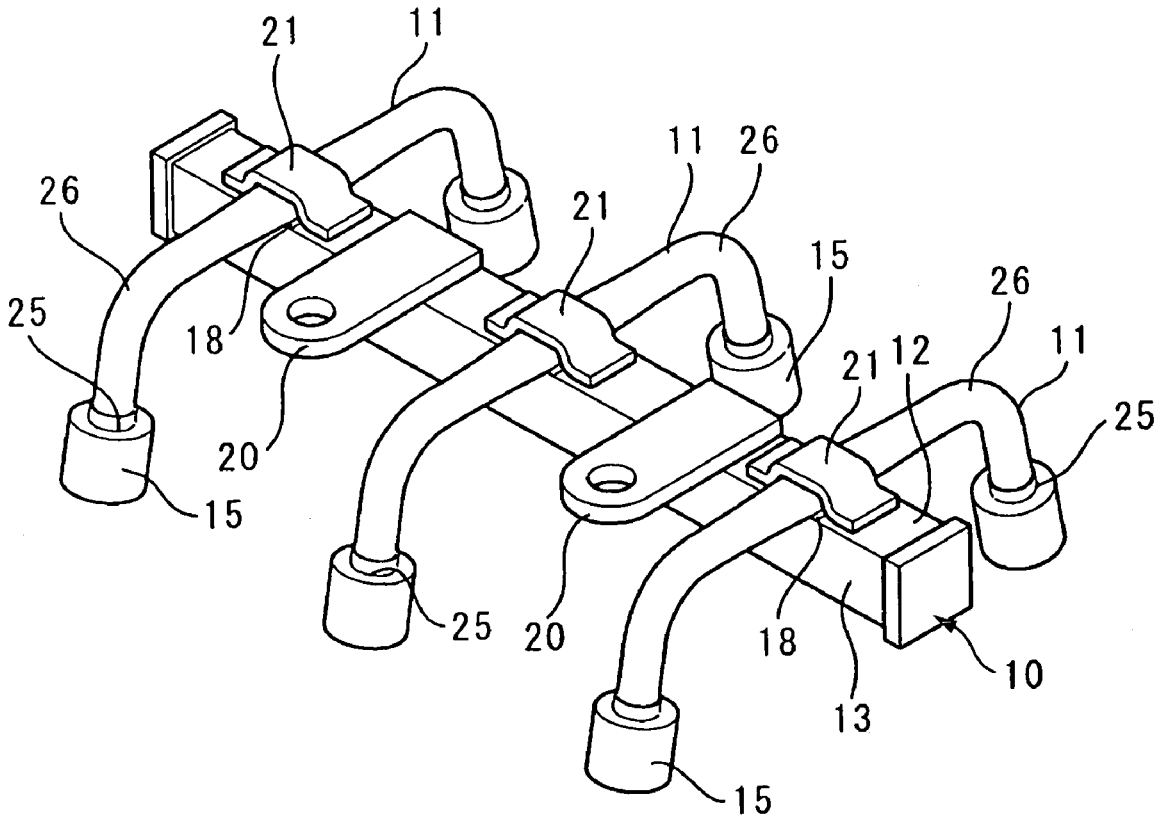
FIG. 4 is a perspective view of a fuel delivery pipe in accordance with a second embodiment of the invention.
Figure 5:
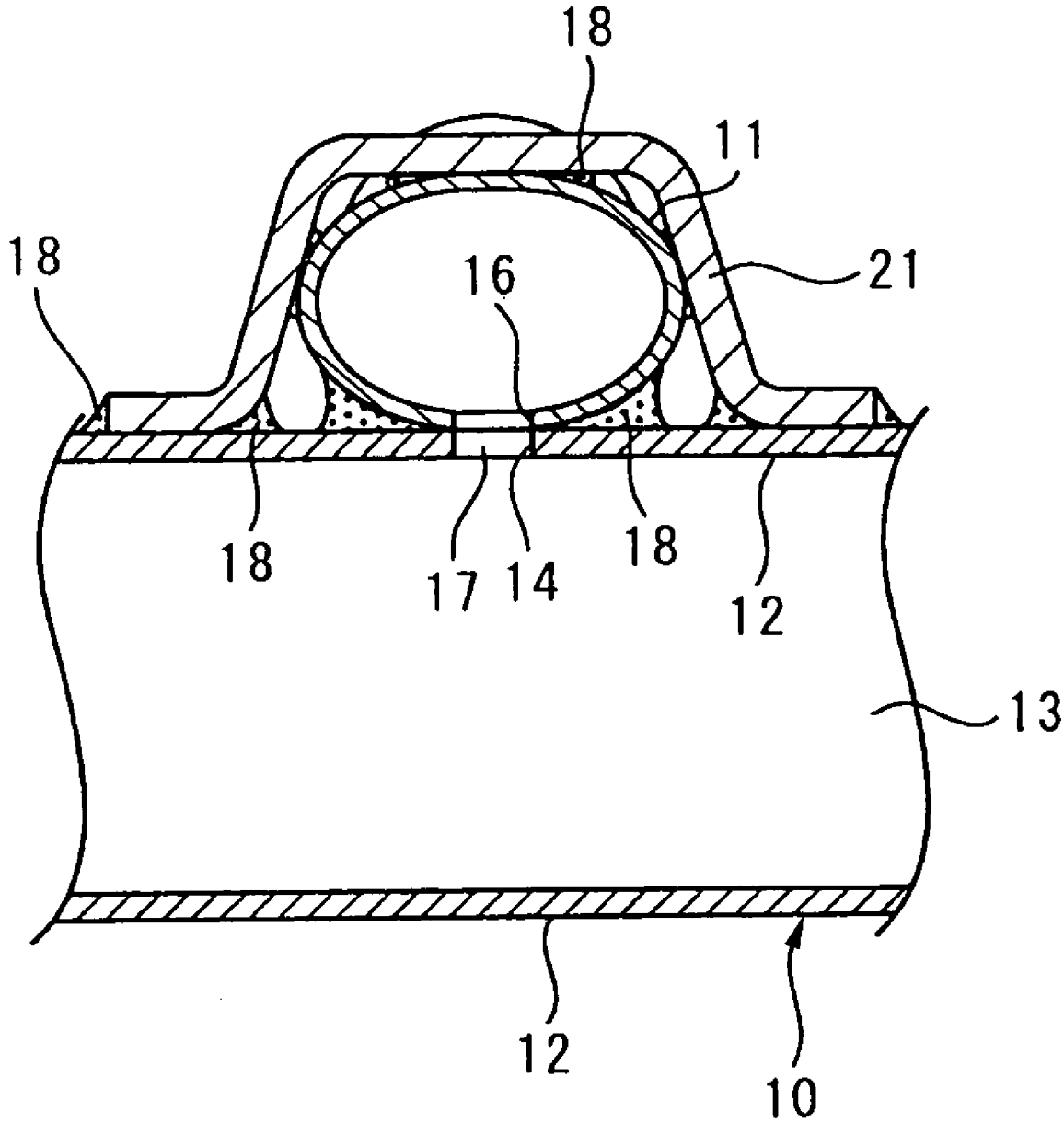
FIG. 5 is a cross-sectional view, taken in the orthogonal direction to the pipe axis of the tubular joint, of the connecting portion between the fuel delivery pipe body and the tubular joint in the second embodiment.

In a second embodiment shown in FIGS. 4 and 5, in the same way as in the first embodiment, the tubular joint 11 having the holder portions 15 respectively provided at both pipe end portions 25 is disposed in contact with the upper or lower wall 12 of the fuel delivery pipe body 10, and the outlet port 14 which is open in this upper or lower wall 12 and the inlet port 16 which is open in the tubular joint 11 are communicated with each other to form the flow path 17. The fuel delivery pipe body 10 and the tubular joint 11 are fixed by welding or brazing at the peripheries of this flow path 17, thereby connecting the fuel delivery pipe body 10 and the tubular joint 11. By adopting such a structure, in the second embodiment as well, it is possible to suppress the amplification of the high-frequency noise in the fuel delivery pipe body 10, and suppress the radiation of the ration noise to the outside to a low level.

Further, in the second embodiment, the connecting portions of the fuel delivery pipe body 10 and the tubular joint 11 are fixed by a solid fixing member 21 made of a metallic material. Both ends of this fixing member 21 are fixed to the upper or lower wall 12 by welding or brazing in such a manner as to straddle the tubular joint 11. At the fixed position of this fixing member 21, it is possible to disperse and absorb the deforming force applied to the upper and lower walls 12 due to such as the flow of the fuel.

Accordingly, it is possible to reduce the flow stress applied to the connecting portion between the fuel delivery pipe body 10 and the tubular joint 11. This flow stress is not only dispersed in the wide contact area of the connecting portion but is also dispersed by the fixing member 21, making it possible to further increase the strength of the connecting portion. Thus, it becomes possible to maintain injection which is free of fuel leakage and the like, and improve the durability of the product. Further, in the pressure pulsation of a lower frequency consequent upon the frequency adjustment in the air column vibration mode, it is possible to suppress the resonance of the fuel delivery pipe body 10 and further enhance the effect of suppressing the radiation noise.

[3rd Embodiment]

Figure 6:
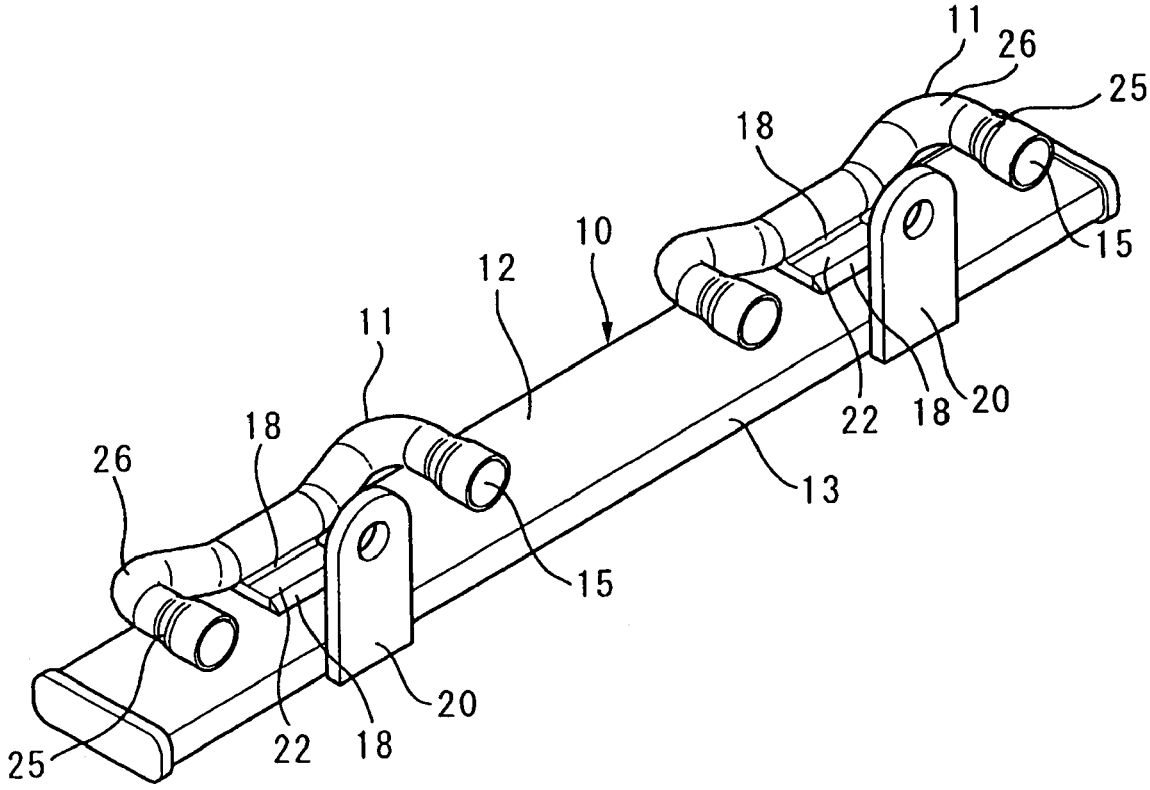
FIG. 6 is perspective view of a fuel delivery pipe in accordance with a third embodiment of the invention.
Figure 7:
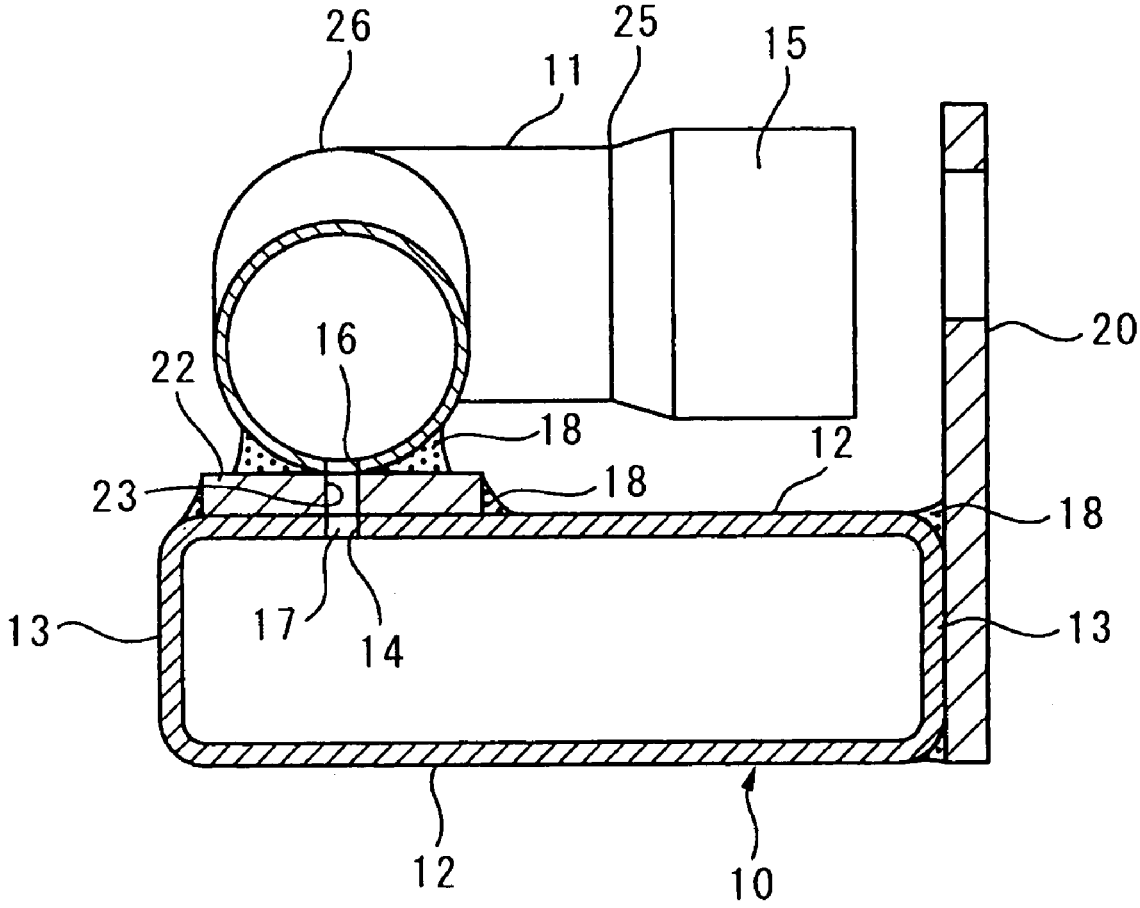
FIG. 7 is a cross-sectional view, taken in the orthogonal direction to the pipe axis of the tubular joint, of the connecting portion between the fuel delivery pipe body and the tubular joint in the third embodiment.

A description will be given of a third embodiment of the invention with reference to FIGS. 6 and 7. Although in the above-described first and second embodiments the fuel delivery pipe body 10 and the tubular joint 11 are directly fixed by welding or brazing, in this third embodiment a solid interposed member 22 made of a metal plate and capable of suppressing the deformation of the contacting upper or lower wall 12 of the fuel delivery pipe body 10 is interposed between the fuel delivery pipe body 10 and the tubular joint 11. This interposed member 22 is connected and fixed to an outer surface of the fuel delivery pipe body 10 by welding or brazing, and the tubular joint 11 is connected and fixed to an upper surface of this interposed member 22 by welding or brazing. By virtue of such an arrangement, the respective surfaces of the upper or lower wall 12 of the fuel delivery pipe body 10, the interposed member 22, and the tubular joint 11 are disposed in parallel and are connected and fixed. In addition, a through hole 23 is bored in the interposed member 22, and the outlet port 14 of the fuel delivery pipe body 10 and the inlet port 16 of the tubular joint 11 are communicated through this through hole 23, thereby forming the flow path 17 for the fuel.

In addition, in the above-described first and second embodiments, the tubular joint 11 having a U-shape in a side view is connected perpendicularly to the fuel delivery pipe body 10 having a square cross section, and the holder portion 15 of the injector 32 is made open on the side of the other one of the upper and lower walls 12 relative to the one of the upper and lower walls 12 of the fuel delivery pipe body 10. In contrast, in the third embodiment, the fuel delivery pipe body 10 is formed into a flat shape with a pair of narrow both side walls 13 and a pair of wide upper and lower walls 12 such that its cross sectional shape is rectangular. In addition, the one of the wide upper and lower walls 12 is formed as a flexible absorbing wall surface, and the tubular joint 11 having a U-shape in a side view is connected to and disposed on the opposite wide upper or lower wall 12 to this absorbing wall surface via the aforementioned interposed member 22 such that their pipe axes become parallel. By virtue of this arrangement, as shown in FIG. 6, the holder portion 15 of the tubular joint 11 is open in the direction toward the side where the one narrow side wall 13 of the fuel delivery pipe body 10 is disposed. The bracket 20 is connected and fixed to this narrow side wall 13.

By interposing the solid interposed member 22 between the fuel delivery pipe body 10 and the tubular joint 11 as in the third embodiment, it is possible to suppress the deformation of the contacting upper or lower wall 12 caused by the flow pressure of the fuel at the connected position of this interposed member 22. Further, the fuel delivery pipe body 10 and the tubular joint 11 can be contacted and fixed with a wide area by the fillets 18 of the interposed member 22 and the metallic material or the brazing filler metal. For this reason, it is possible to reduce the flow stress applied to the connecting portion between the fuel delivery pipe body 10 and the tubular joint 11. Further, this flow stress is dispersed by the connecting portion having a wide contact area and the interposed member 22, making it possible to further increase the connection strength of the connecting portion and improve the connection stability. Thus, satisfactory fuel injection which is free of fuel leakage and the like is made possible.

In addition, in the third embodiment as well, as the holder portion 15 and the fuel delivery pipe body 10 are connected via the tubular joint 11, the frequency of the pressure pulsation from the fuel flow member 33 including the injector 32 is set to a low frequency consequent upon the frequency adjustment in the air column vibration mode, so that it is possible to suppress the resonance of the fuel delivery pipe body 10 and suppress the radiation of the high-frequency noise to the outside to a low level.

[4th Embodiment]

Figure 8:
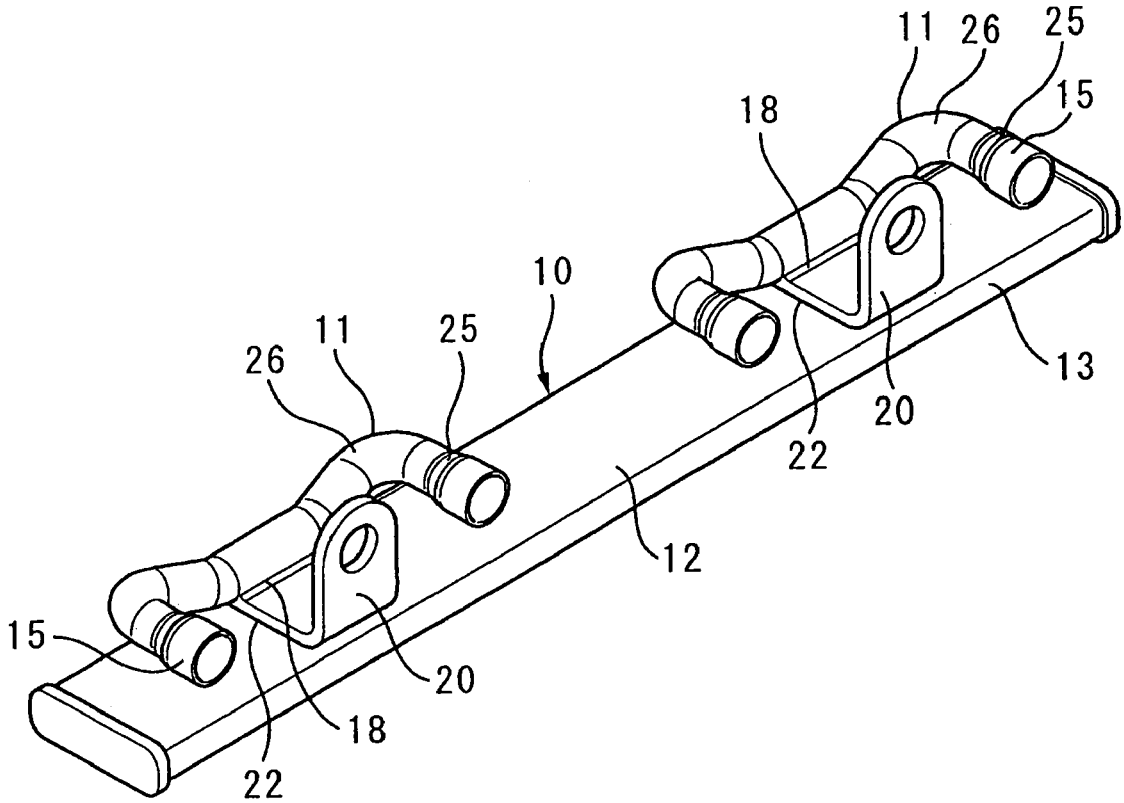
FIG. 8 is a perspective view of a fuel delivery pipe in accordance with a fourth embodiment of the invention.
Figure 9:
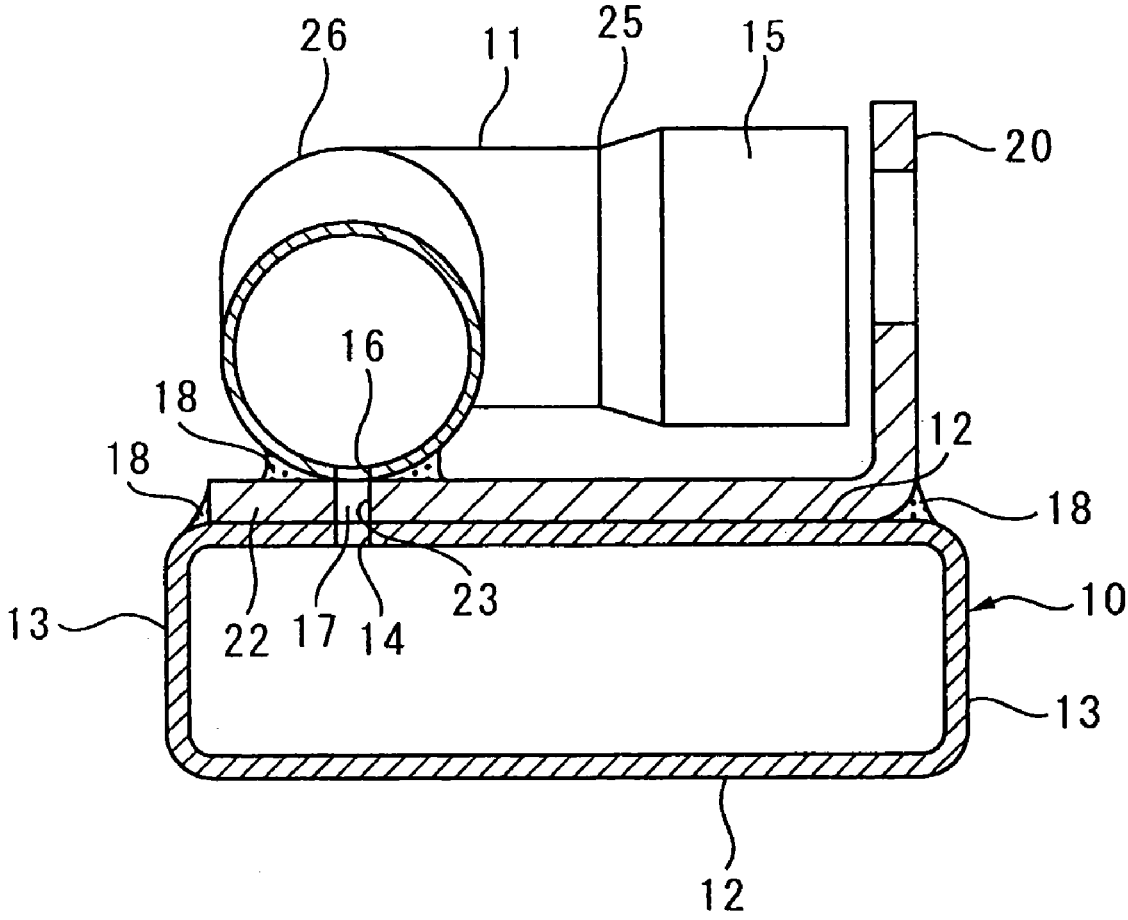
FIG. 9 is a cross-sectional view, taken in the orthogonal direction to the pipe axis of the tubular joint, of the connecting portion between the fuel delivery pipe body and the tubular joint in the fourth embodiment.

A description will be given of a fourth embodiment of the invention with reference to FIGS. 8 and 9. Although in the above-described third embodiment the interposed member 22 made of a metallic plate and separate from the bracket 20 is used, in this fourth embodiment the bracket 20 is used in common as the interposed member 22. In terms of its construction, the bracket 20 having an L-shape in a side view is fixed by welding or brazing to the wide upper or lower wall 12 of the flat-shaped fuel delivery pipe body 10 whose cross-sectional shape is rectangular. Further, two tubular joints 11 each having a U-shape in a side view are respectively fixed to the upper surfaces of these brackets 20 by welding or brazing, and the tubular joints 11 are thereby connected to the one of the upper and lower walls 12 via the brackets 20. Thus, a product of a four-cylinder specification is obtained. In addition, the through hole 23 is bored in the bracket 20, and the outlet port 14 which is open in the upper or lower wall 12 and the inlet port 16 which is open in the side surface of the tubular joint 11 are communicated through this through hole 23, thereby forming the flow path 17 for the fuel. The bracket 20 and the tubular joint 11 are fixed by welding or brazing at the outer periphery of this flow path 17.

In this fourth embodiment as well, via the bracket 20, the fuel delivery pipe body 10 and the tubular joint 11 can be contacted and disposed with a wide contact area such that their respective wall surfaces become parallel. At the same time, it is possible to suppress the deformation of the contacting upper or lower wall 12 due to the flow pressure of the fuel by the rigidity of the bracket 20. Accordingly, it becomes possible to prevent the partial concentration of the flow stress on the connecting portion between the fuel delivery pipe body 10 and the tubular joint 11, and maintain smooth fuel injection which is free of fuel leakage and the like. In addition, the overall length of the fuel flow member 33 can be elongated by the interposition of the tubular joint 11. Accordingly, the frequency of the pressure pulsation propagated from the injector 32 side through the fuel can be made a low frequency based on the frequency adjustment in the air column vibration mode. As a result, it becomes possible to suppress the resonance of the fuel delivery pipe body 10 and to damp the mechanical vibrations propagated through the surface of the fuel flow member 33. Thus, it becomes possible to suppress the amplification of the radiation noise due to the fuel delivery pipe body 10, thereby making it possible to reduce the noise radiated to the outside to a low level.

It should be noted that although in the above-described third and fourth embodiments only the upper or lower wall 12 where the bracket 20 is not attached is used as the absorbing wall surface, the upper or lower wall 12 where the bracket 20 is attached may also be used as the absorbing wall surface. In this case as well, the absorbing wall surface is flexurally deformed by the flow pressure of the fuel, but the deformation is suppressed at the portion where the bracket 20 is connected. Hence, it is possible reduce the flow stress applied to the connecting portion between the fuel delivery pipe body 10 and the tubular joint 11.

[5th Embodiment]

Figure 10:
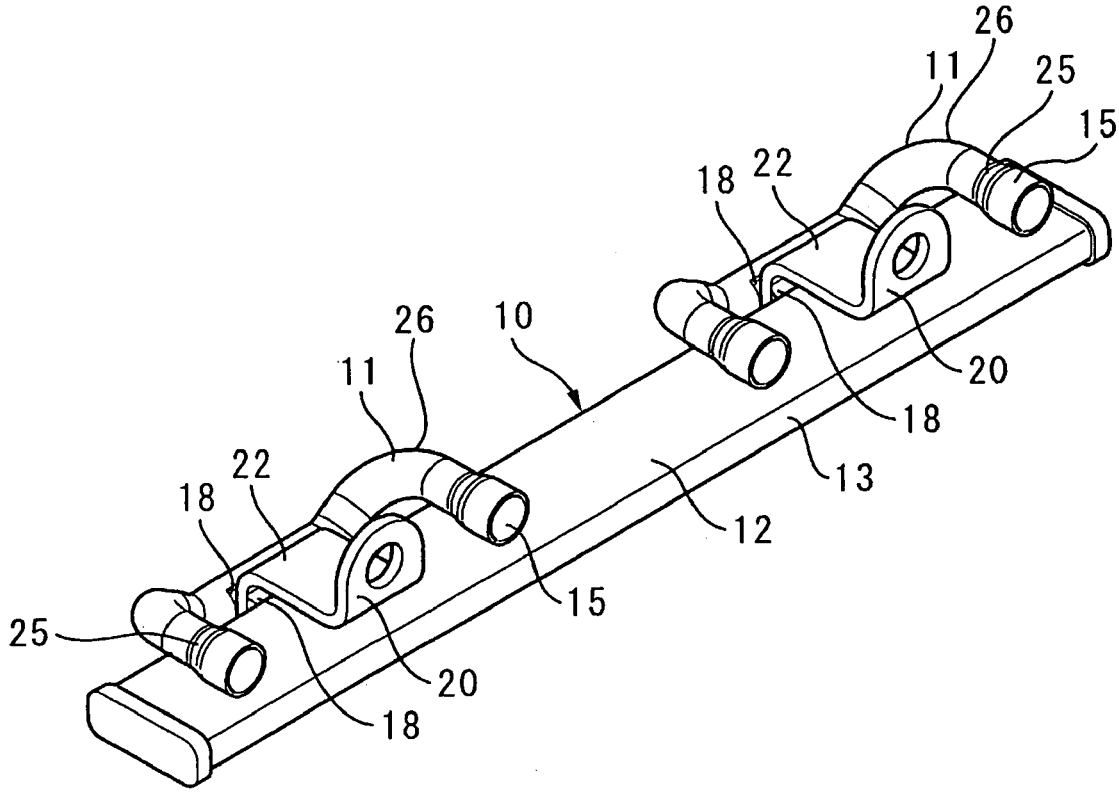
FIG. 10 is a perspective view of a fuel delivery pipe in accordance with a fifth embodiment of the invention.
Figure 11:
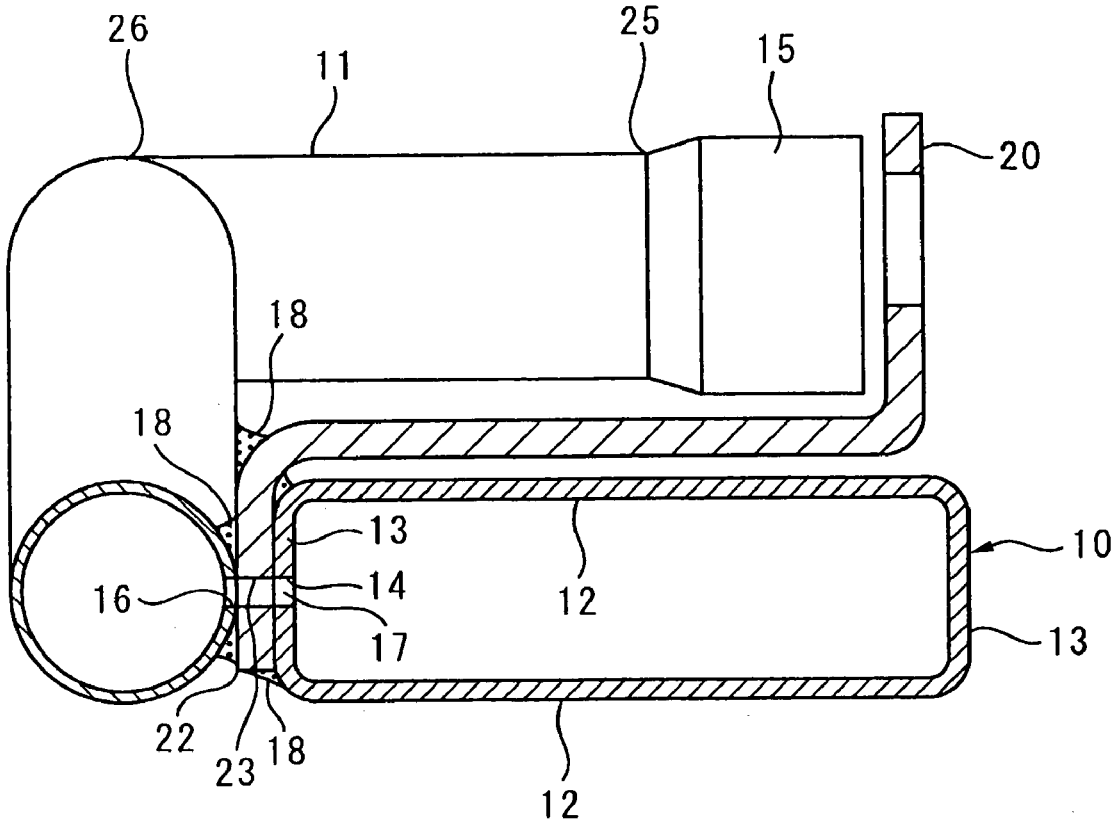
FIG. 11 is a cross-sectional view, taken in the orthogonal direction to the pipe axis of the tubular joint, of the connecting portion between the fuel delivery pipe body and the tubular joint in the fifth embodiment.

Next, a description will be given of a fifth embodiment of the invention with reference to FIGS. 10 and 11. In the above-described fourth embodiment, the tubular joint 11 is connected to the wide upper or lower wall 12 via the bracket 20 having an L-shape in a side view. Further, the outlet port 14 which is open in the wide upper or lower wall 12 and the inlet port 16 which is open in the side surface of the tubular joint 11 are communicated through the through hole 23 in the bracket 20. In contrast, in the fifth embodiment, as shown in FIG. 11, the bracket 20 which is crank-shaped in a side view is fixed to one of the narrow side walls 13 by welding or brazing, but the upper or lower wall 12 and the bracket 20 are not connected and fixed, and a gap is provided therebetween. Further, the tubular joint 11 is connected to the narrow side wall 13 via the bracket 20. Thus, since the bracket 20 and the tubular joint 11 are not connected to the wide upper or lower wall 12, both of the pair of wide upper and lower walls 12 can be used as the flexible absorbing wall surfaces.

In addition, the outlet port 14 for the fuel is provided in one of the narrow side walls 13 of the fuel delivery pipe body 10, and the through hole 23 is provided in the bracket 20 at a position corresponding to this outlet port 14. The outlet port 14 and the through hole 23 are communicated with the inlet port 16 in the tubular joint 11, thereby forming the flow path 17 between the fuel delivery pipe body 10 and the tubular joint 11. The bracket 20 and the tubular joint 11 are fixed by welding or brazing at the outer periphery of this flow path 17.

In this fifth embodiment as well, the fuel delivery pipe body 10 and the tubular joint 11 can be contacted and disposed with a wide contact area via the bracket 20, such that their respective wall surfaces are parallel. Hence, it is possible to disperse the flow stress applied to the connecting portion and suppress the partial concentration of the flow stress. Further, it is possible to reduce the flow stress by absorbing the deforming force with respect to the side wall 13 at the position where the bracket 20 is attached. Accordingly, the connection strength of the connecting portion between the fuel delivery pipe body 10 and the tubular joint 11 becomes firm, and the connection stability increases. Therefore, it is possible to maintain the air tightness of the connecting portion over long periods of time, and fuel injection which is free of fuel leakage and the like becomes possible. In addition, it is possible to suppress the radiation of the high-frequency noise to the outside to a low level by virtue of the effect of dispersion of the flow stress at the connecting portion by the interposed member 22, as well as the effect of preventing by the tubular joint 11 the resonance of the fuel delivery pipe body 10 with the low-frequency pressure pulsation and mechanical vibrations from the injector 32 side consequent upon the frequency adjustment in the air column vibration mode.

[6th Embodiment]

Figure 12:
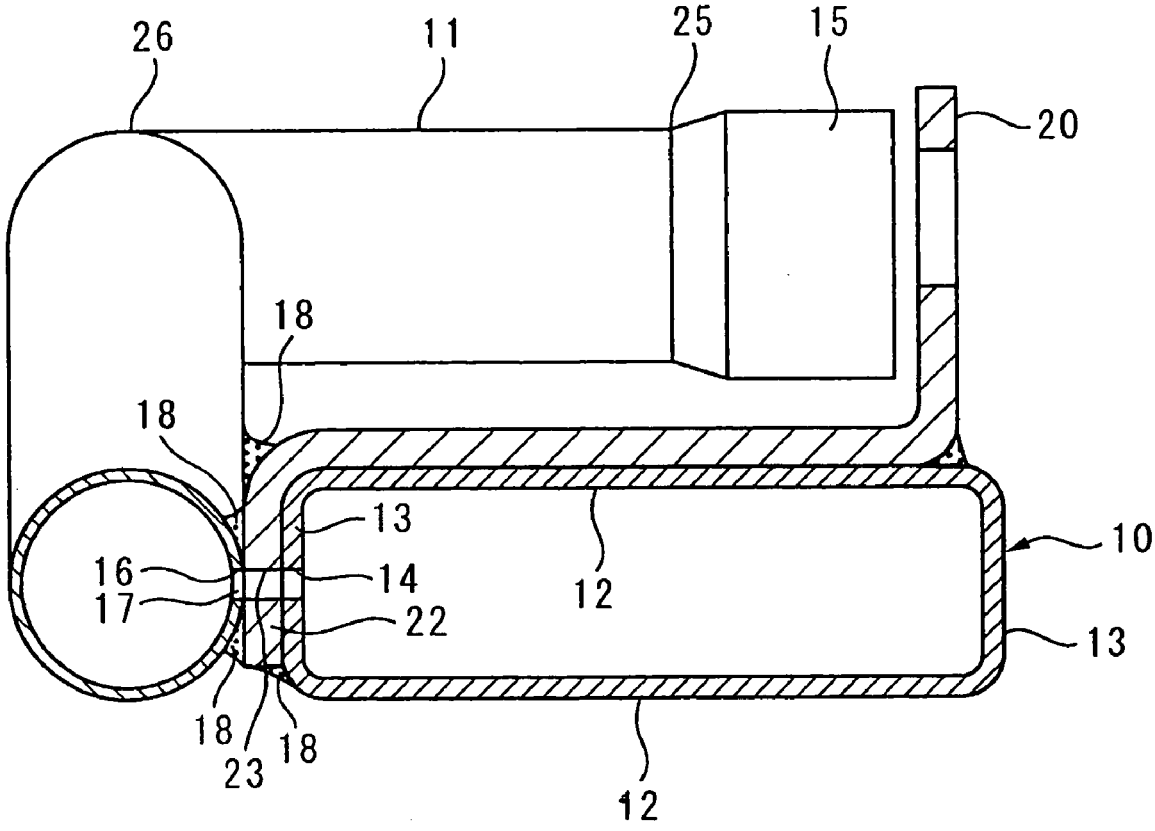
FIG. 12 is a cross-sectional view, taken in the orthogonal direction to the pipe axis of the tubular joint, of the connecting portion between the fuel delivery pipe body and the tubular joint in a sixth embodiment.

In addition, in the above-described fifth embodiment the bracket 20 is connected and fixed to only either side wall 13 and is not fixed to the upper or lower wall 12, but in a sixth embodiment shown in FIG. 12, the bracket 20 is fixed to one side wall 13 and one of the upper and lower walls 12 by welding or brazing. Further, the tubular joint 11 is fixed by welding or brazing to the side wall 13 via this bracket 20.

[7th Embodiment]

Figure 13:
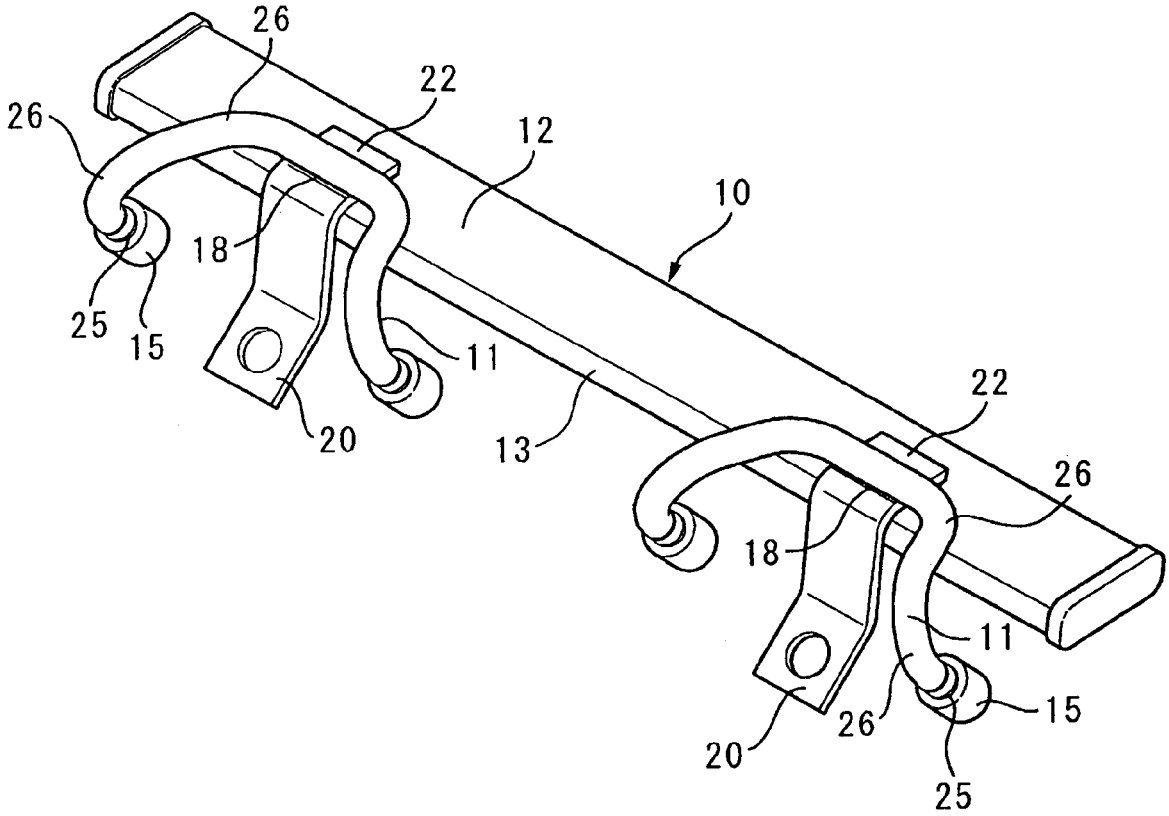
FIG. 13 is a perspective view of a fuel delivery pipe in accordance with a seventh embodiment of the invention.
Figure 14:
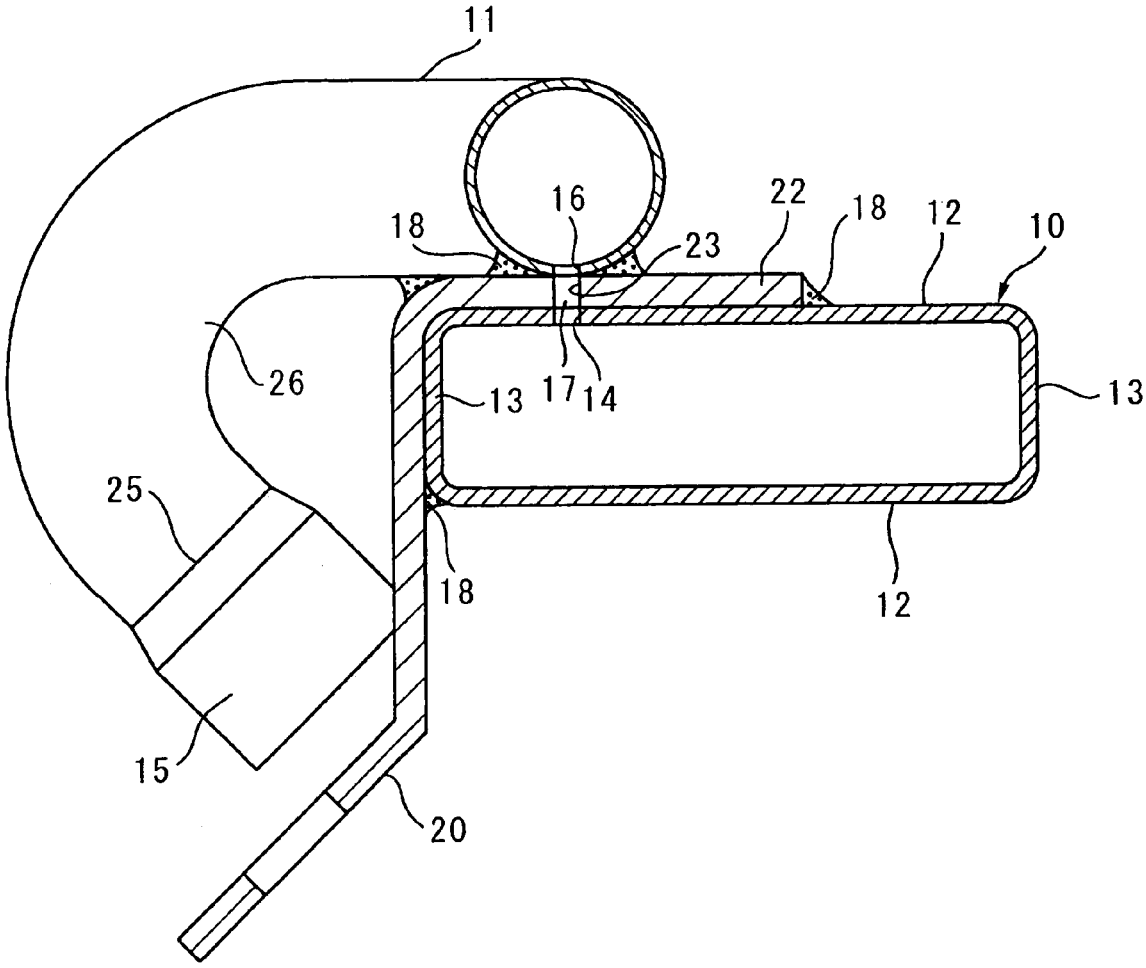
FIG. 14 is a cross-sectional view, taken in the orthogonal direction to the pipe axis of the tubular joint, of the connecting portion between the fuel delivery pipe body and the tubular joint in the seventh embodiment.

Next, a description will be given of a seventh embodiment of the invention with reference to FIGS. 13 and 14. In this seventh embodiment, the bracket 20 is fixed to one of the upper and lower walls 12 and one of the side walls 13 by welding or brazing, and the tubular joint 11 is fixed by welding or brazing to an outer surface of the portion of the bracket 20 fixed to the one of the upper and lower walls 12. As for this tubular joint 11, both side portions each located between the inlet port 16 and the holder portion 15 are bent at two positions on each side, thereby providing two bent portions 26 on each side. The bent portion 26 on the holder portion 15 side is formed in such a manner as to be curved arcuately along a direction from the one of the upper and lower walls 12 on the attached side toward the other one of the upper and lower walls 12, and the other one of the upper and lower walls 12 serves as the absorbing wall surface. Accordingly, the injector 32 is disposed below the lower surface of the other one of the upper and lower walls 12 serving as the absorbing wall surface. Hence, it becomes possible to isolate the radiation noise from the injector 32 during fuel injection by this other one of the upper and lower walls 12. Thus, it becomes possible to further enhance the effect of reducing the radiation noise obtained by adjusting the frequency in the air column vibration mode to a low frequency by connecting the holder portion 15 and the fuel delivery pipe body 10 via the tubular joint 11.

[8th Embodiment]

Figure 15:
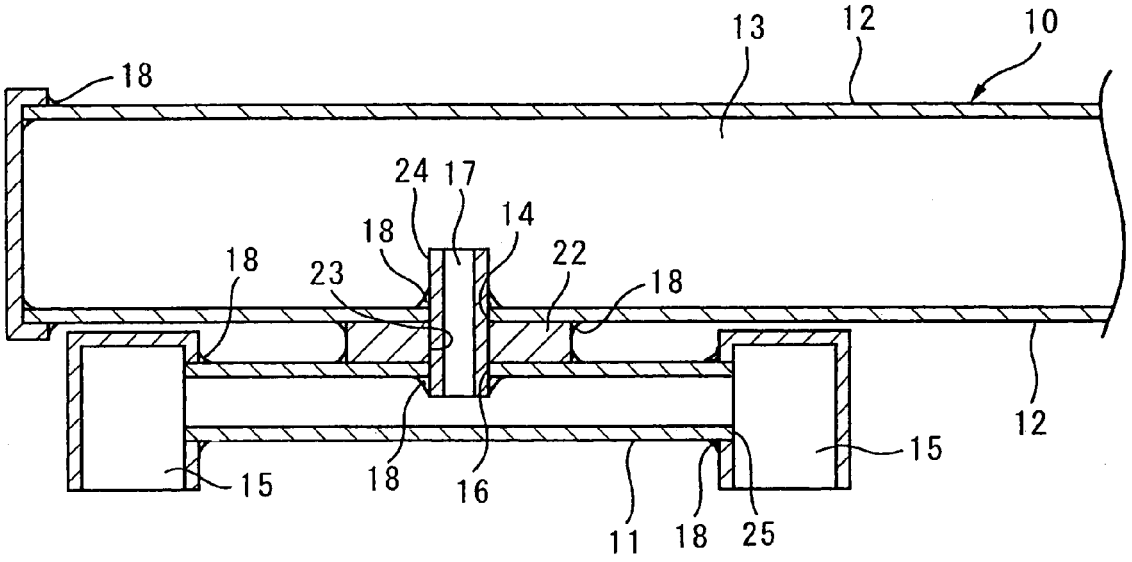
FIG. 15 is a cross-sectional view, taken in the parallel direction to the pipe axis of the tubular joint, of the connecting portion between the fuel delivery pipe body and the tubular joint in an eighth embodiment.

A description will be given of an eighth embodiment with reference to FIG. 15. In this eighth embodiment, a rectilinear tubular joint 11 having holder portions 15 at both pipe end portions 25 is disposed on and fixed to one of the upper and lower walls 12 such that their pipe axes become parallel.

Further, the solid interposed member 22 made of a metal plate and capable of suppressing the deformation of this upper or lower wall 12 is interposed between the tubular joint 11 and the one of the upper and lower walls 12. This interposed member 22 and each of the fuel delivery pipe body 10 and the tubular joint 11 are fixed by welding or brazing, and the outlet port 14 of the fuel delivery pipe body 10, the through hole 23 of the interposed member 22, and the inlet port 16 of the tubular joint 11 are communicated, thereby forming the flow path 17 for the fuel.

Furthermore, in the eighth embodiment, a flow pipe 24 is inserted in the outlet port 14, the through hole 23, and the inlet port 16. The outer peripheral surface of this flow pipe 24 and the respective inner wall surfaces of the upper or wall 12 of the fuel delivery pipe body 10 and the tubular joint 11 where the flow pipe 24 projects are fixed by welding or brazing. The interior of this flow path 24 is used as the flow path 17 for the fuel. As a result of the disposition of this flow pipe 24, the alignment of the outlet port 14, the through hole 23, and the inlet port 16 can be performed reliably. Thus, it is possible to secure the flow path 17 allowing smooth flow of fuel between the fuel delivery pipe body 10 and the tubular joint 11, and prevent the closure of the flow path 17 due to such as the drooping of the brazing filler material. Accordingly, smooth and reliable supply of fuel is made possible from the fuel delivery pipe body 10 to the injector 32 through the tubular joint 11.

Furthermore, by virtue of the presence of this flow pipe 24, the strength of the connecting portion between the fuel delivery pipe body 10 and the tubular joint 11 is increased, and the flow path 24 serves as a support when stress is applied to the connecting portion. As a result, it is possible to more effectively prevent the occurrence of a crack in the fillet 18 and its vicinity. Further, it becomes possible to maintain the connection stability and airtightness of the connecting portion over long periods of time, and maintain satisfactory fuel injection which is free of fuel leakage and the like. In addition, it is possible to suppress the radiation of the high-frequency noise to the outside to a low level by virtue of the effect of dispersion of the flow stress at the connecting portion by the interposed member 22, as well as the effect of preventing by the tubular joint 11 the resonance of the fuel delivery pipe body 10 with the pressure pulsation and mechanical vibrations from the injector 32 side consequent upon the adjustment to a low frequency in the air column vibration mode.

[9th Embodiment]

Figure 16:
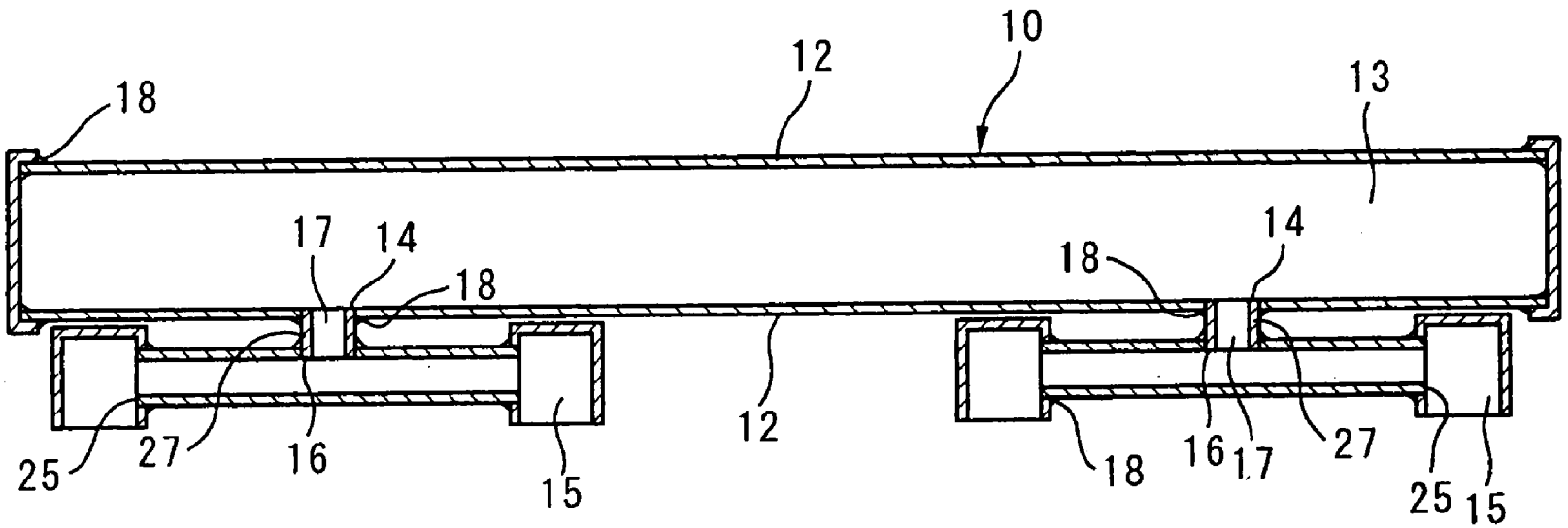
FIG. 16 is a cross-sectional view, taken in the parallel direction to the pipe axis of the tubular joint, of the connecting portion between the fuel delivery pipe body and the tubular joint in a ninth embodiment.

A description will be given of a ninth embodiment with reference to FIG. 16. In the above-described first to eighth embodiments, the tubular joint 11 is disposed in contact with the outer surface of the fuel delivery pipe body 10 to allow the outlet port 14 of the fuel delivery pipe body 10 and the inlet port 16 of the tubular joint 11 to communicate with each other. In contrast, in the ninth embodiment, the outlet port 14 of the fuel delivery pipe body 10 and the inlet port 16 of the tubular joint 11 are connected via a connection pipe 27 provided on the outer surface of the fuel delivery pipe body 10. In addition, the bent portions 26 are not provided in the tubular joint 11 and are formed as a straight-shaped tubular joint 11, and the holder portions 15 are respectively provided at its both pipe end portions 25

This straight-shaped tubular joint 11 is disposed on the outer surface of the fuel delivery pipe body 10 such that their respective pipe axes become parallel, and the connection pipe 27 is inserted into the outlet port 14 of the fuel delivery pipe body 10 and the inlet port 16 of the tubular joint 11. The outer peripheral surface of this connection pipe 27 and the respective wall surfaces are fixed by welding or brazing, thereby connecting and fixing the fuel delivery pipe body 10 and the tubular joint 11.

In the ninth embodiment, it becomes possible to form the fuel delivery pipe easily with a more simple structure. As the length from the center of the inlet port 16 to the pipe end portion 25 of the tubular joint 11 is formed in the range of 30 mm to 1000 mm, it becomes possible to prevent the resonance of the fuel delivery pipe body 10 with the pressure pulsation and mechanical vibrations from the injector 32 side consequent upon the adjustment to a low frequency in the air column vibration mode. Further, it becomes possible to suppress the radiation to a low level of the high-frequency noise such as clattering noise at the time when the spool is seated onto the valve seat.

[10th Embodiment]

Figure 17:
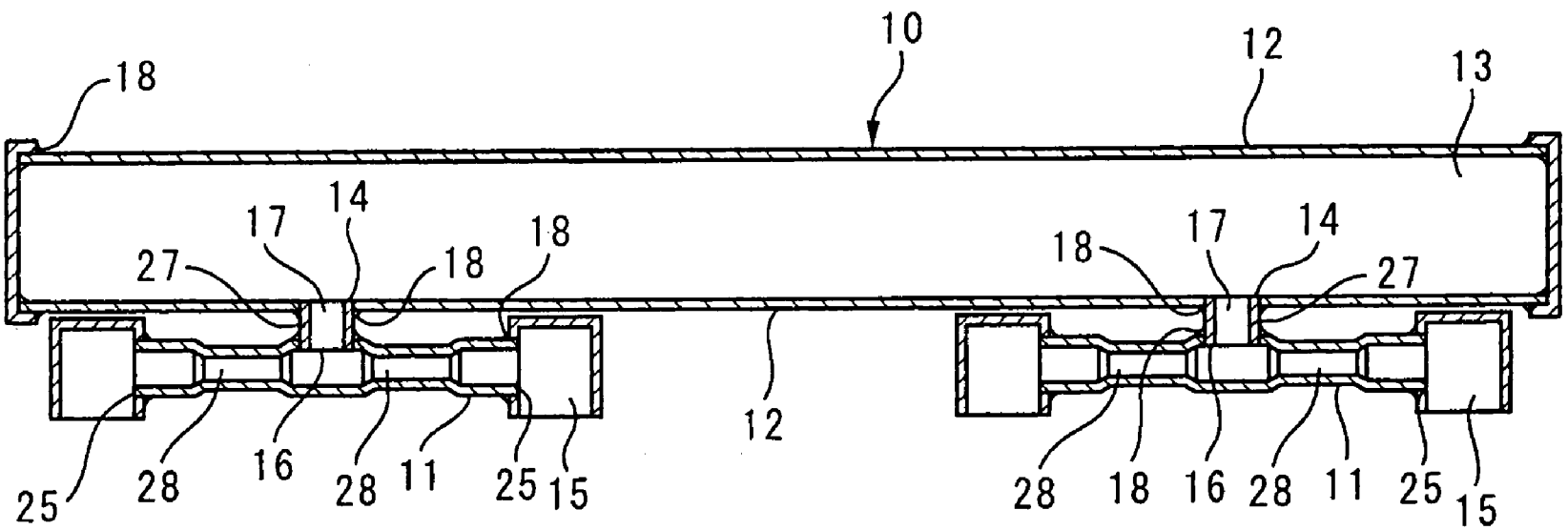
FIG. 17 is a cross-sectional view, taken in the parallel direction to the pipe axis of the tubular joint, of the connecting portion between the fuel delivery pipe body and the tubular joint in a 10th embodiment.

Referring to FIG. 17, a description will be given of a 10th embodiment which shows another different example in which the fuel delivery pipe body 10 and the tubular joint 11 are connected by the connection pipe 27. In the 10th embodiment as well, the tubular joint 11 is formed in a straight shape without providing the bent portions 26, and both side portions of the flow route of the fuel in this tubular joint 11 are constricted to provide constricted portions 28. By the provision of these constricted portions 28, the large pressure pulsation caused by the water hammer phenomenon on closing of the injector 32 can be damped as the pressure pulsation passes through the constricted portions 28. Thus, it becomes possible to prevent the propagation of the pressure pulsation to the fuel delivery pipe body 10.

[11th Embodiment]

Figure 18:
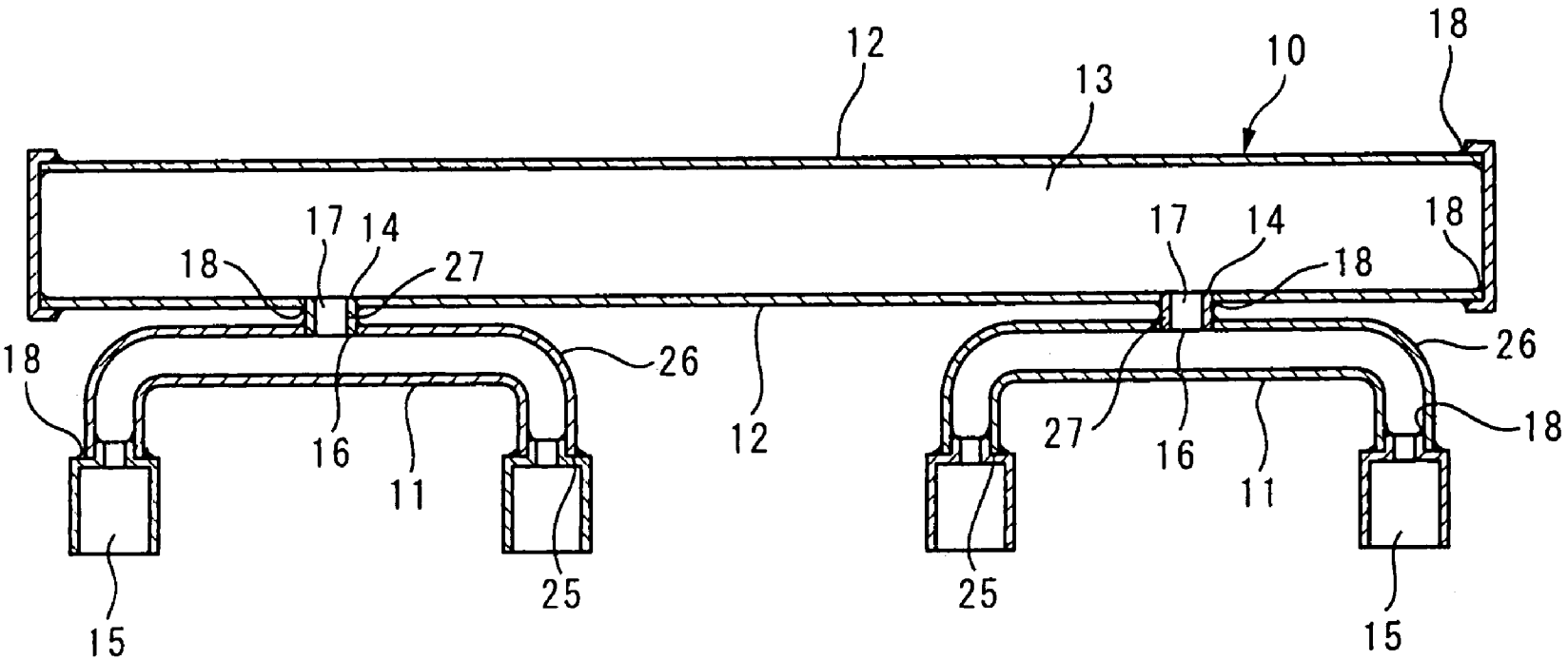
FIG. 18 is a cross-sectional view, taken in the parallel direction to the pipe axis of the tubular joint, of the connecting portion between the fuel delivery pipe body and the tubular joint in an 11th embodiment.

In addition, in an 11th embodiment showing still another different example using the connection pipe 27, as shown in FIG. 18, both side portions each located between the fuel inlet port 16, which is open in the center of the side surface of the tubular joint 11, and the respective pipe end portion 25 are bent substantially orthogonally to provide the bent portions 26 one on each side, so that the tubular joint 11 in a side view is formed in a U-shape. By providing the bent portions 26 as in this 11th embodiment and in the above-described embodiments 1 to 7, the rigidity of the tubular joint 11 is lowered, and the resiliency is enhanced. In consequence, by changing the direction of propagation of the energy of pressure pulsation from the injector 32 side consequent upon the adjustment to a low frequency in the air column vibration mode, it becomes possible to further improve the absorbability of the pressure pulsation. Hence, it becomes possible to suppress the generation of the radiation noise from the fuel delivery pipe body 10 to an even lower level.

[12th Embodiment]

Figure 19:
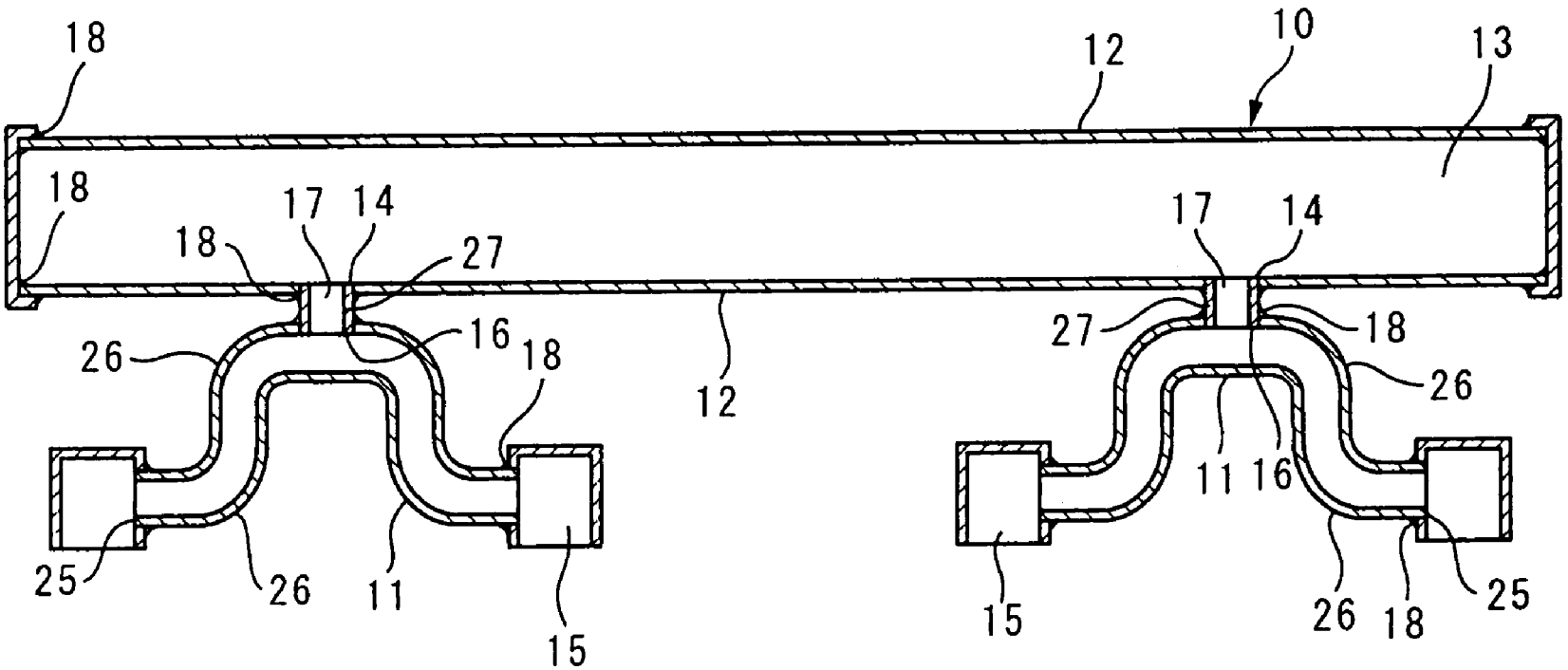
FIG. 19 is a cross-sectional view, taken in the parallel direction to the pipe axis of the tubular joint, of the connecting portion between the fuel delivery pipe body and the tubular joint in a 12th embodiment.

In addition, in a 12th embodiment showing a further different example using the connection pipe 27, as shown in FIG. 19, both side portions of the tubular joint 11 each located between the fuel inlet port 16, which is open in the center of the side surface of the tubular joint 11, and the respective pipe end portion 25 are orthogonally bent at two positions on each side, thereby providing two bent portions 26 on each side. The tubular joint 11 in a side view is shaped in the form of a tenon. Thus, by providing the bent portions 26 in a large number, the resiliency due to a decline in the rigidity of the tubular joint 11 is further enhanced. In consequence, by changing twice the direction of propagation of the energy of pressure pulsation from the injector 32 side consequent upon the adjustment to a low frequency in the air column vibration mode, it becomes possible to effectively absorb the pressure pulsation and enhance the effect of suppressing the radiation noise.

[13th Embodiment]

Figure 20:
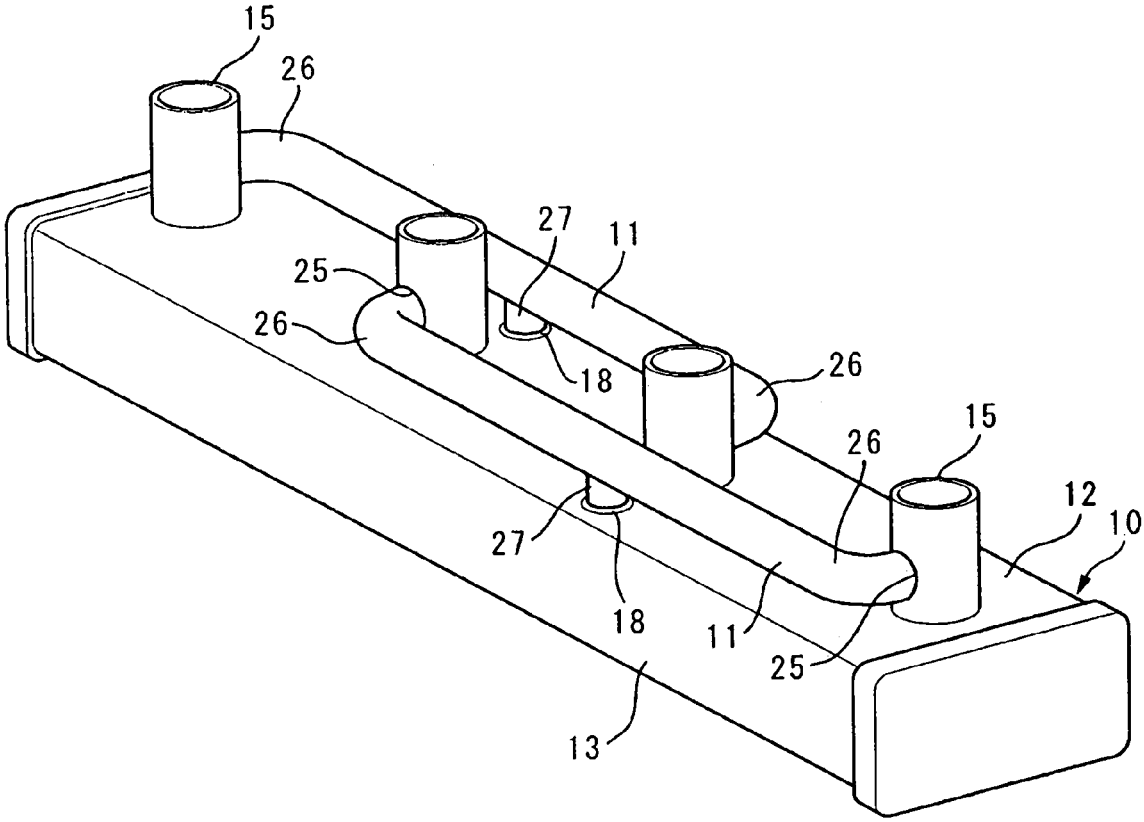
FIG. 20 is a perspective view of a fuel delivery pipe in accordance with a 13th embodiment of the invention.

Referring now to FIG. 20, a description will be given of a 13th embodiment showing a still further different example using the connection pipe 27. For example, in the 11th embodiment shown in FIG. 18, four holder portions 15 are arranged in series in the direction of the pipe axis with respect to the fuel delivery pipe body 10, and a first holder portion 15 and a second holder portion 15 which are adjacent to each other are connected to one tubular joint 11 disposed in parallel to the pipe axis of the fuel delivery pipe body 10, and a third holder portion 15 and a fourth holder portion 15 are connected to the other tubular joint 11. Since there is a need to arrange the four holder portions 15 at equal intervals without causing the two tubular joints 11 to contact each other, there has been a limit to making the tubular joints 11 elongated.

Accordingly, in the 13th embodiment shown in FIG. 20, the outlet ports 14 are opened in the upper or lower wall 12 of the fuel delivery pipe body 10 in an offset manner, and the two tubular joints 11 are fixed in these outlet ports 14 via the connection pipes 27. As for these tubular joints 11, both pipe end portion (25) sides are bent orthogonally to provide the bent portions 26 such that the tubular joint 11 in a side view is formed in a U-shape. Further, the pipe end portions 25 of the one and the other tubular joints 11 are disposed in face-to-face relation to each other. The first holder portion 15 and the third holder portion 15 are connected to both pipe end portions 25 of the one tubular joint 11, while the second holder portion 15 and the fourth holder portion 15 are connected to both pipe end portions 25 of the other tubular joint 11.

By adopting the above-described construction, it is possible to make the length of the tubular joints 11 more elongated, and enhance the effect of suppressing the radiation noise by the adjustment to a lower frequency in the air column vibration mode. In addition, the injectors 32 can be arranged in series at equal intervals via the holder portions 15, no hindrance is caused to the fuel injection from the injectors 32, and the layout feature is not affected, either.

[14th Embodiment]

Figure 21:
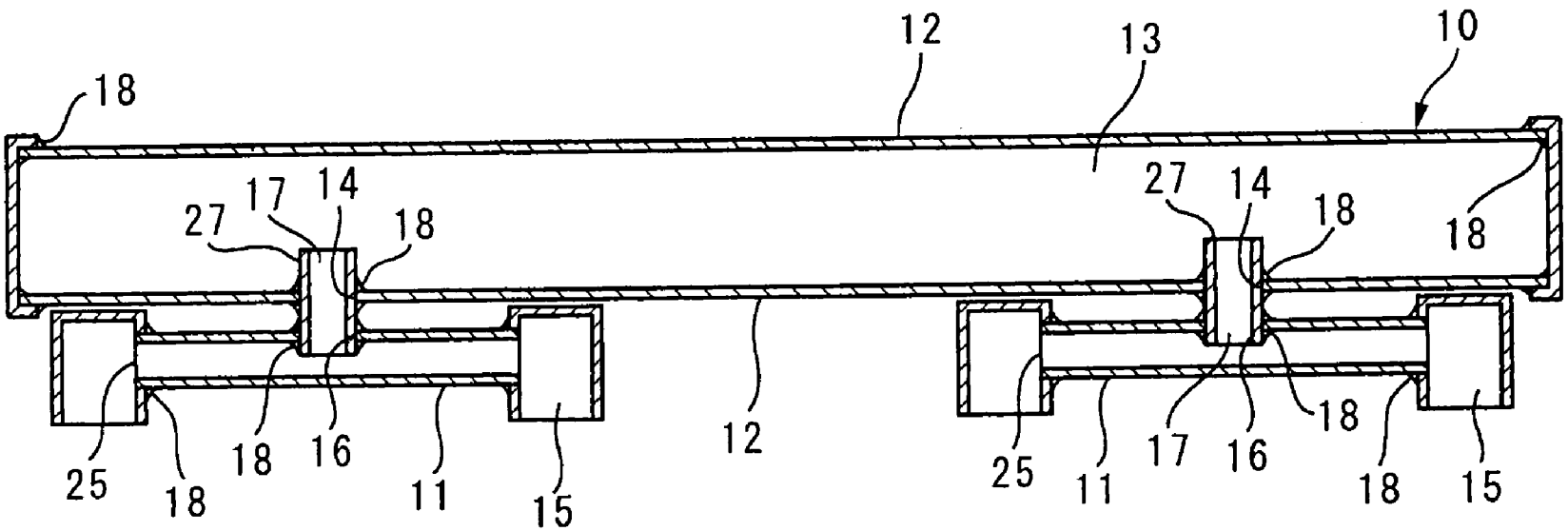
FIG. 21 is a cross-sectional view, taken in the parallel direction to the pipe axis of the tubular joint, of the connecting portion between the fuel delivery pipe body and the tubular joint in a 14th embodiment.

In addition, in a 14th embodiment shown in FIG. 21, the connection pipe 27 for connecting the outlet port 14 of the fuel delivery pipe body 10 and the inlet port 16 of the tubular joint 11 is formed to be elongated. Both ends of this connection pipe 27 are caused to project into the inner space of the fuel delivery pipe body 10 and the inner space of the tubular joint 11, respectively. The outer periphery of this connection pipe 27 and each of the inner wall surface of the fuel delivery pipe body 10 and the inner wall surface of the tubular joint 11 are fixed by welding or brazing.

By adopting the construction as in the 14th embodiment, the connection pipe 27, the outlet port 14, and the inlet port 16 can be aligned reliably, the connection stability of the respective members improves, and the durability against vibrations and the like improves. Hence, it becomes possible to prevent the occurrence of a crack in the fillet 18 and its vicinity. In addition, it becomes possible to prevent the closure of the flow path 17 due to such as the drooping of the brazing filler material, thereby permitting smooth supply of fuel from the fuel delivery pipe body 10 to the injector 32. Furthermore, it becomes possible to suppress the generation of the radiation noise to a low level by the effect of suppressing the resonance of the fuel delivery pipe body 10 consequent upon the adjustment to a low frequency in the air column vibration mode of the tubular joint 11 formed to be elongated.

[15th Embodiment]

Figure 22:
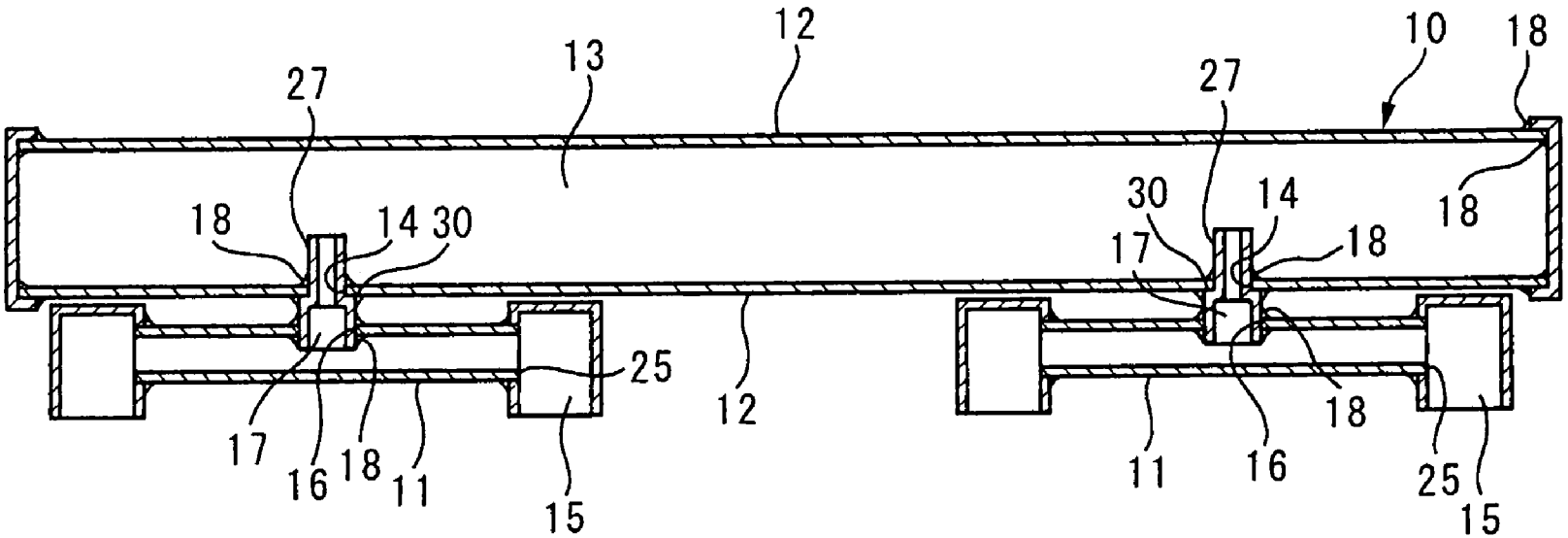
FIG. 22 is a cross-sectional view, taken in the parallel direction to the pipe axis of the tubular joint, of the connecting portion between the fuel delivery pipe body and the tubular joint in a 15th embodiment.

In addition, in a fifteenth embodiment shown in FIG. 22, the connection pipe 27 is made elongated, and its both ends are caused to project into the inner space of the fuel delivery pipe body 10 and the inner space of the tubular joint 11. At the same time, the fuel delivery pipe body 10 side of the connection pipe 27 is formed with a small diameter, and an engaging stepped portion 30 is provided on the connection pipe 27. This engaging stepped portion 30 is abutted against the outer surface of the fuel delivery pipe body 10, and these members are fixed by welding or brazing.

Since the engaging stepped portion 30 is thus provided, it becomes possible to reliably perform alignment to a correct (or right) dimension at the time of connection between the connection pipe 27 and the fuel delivery pipe body 10. Further, the connection strength and connection stability of the connecting portion increases, and the durability against vibrations and the like improves, thereby making it possible to prevent such as the occurrence of a crack in the fillet 18 and its vicinity. In addition, in this embodiment as well, it is possible to obtain the effect of preventing the closure of the flow path 17 due to such as the drooping of the brazing filler material, as well as the effect of suppressing the generation of the radiation noise to a low level by the effect of the tubular joint 11 formed to be elongated. It should be noted that although in this embodiment the connection pipe 27 has the engaging stepped portion 30 provided on the fuel delivery pipe body 10 side, as another different embodiment the connection pipe 27 may be formed by providing the engaging stepped portion 30 on the tubular joint 11 side so as to enhance the connection stability with respect to the tubular joint 11. In addition, by forming the connection pipe 27 by providing the engaging stepped portion 30 on each of the fuel delivery pipe body 10 side and the tubular joint 11 side, it becomes possible to improve the connection strength and connection stability of the respective members, thereby making it possible to manufacture a product further excelling in durability.

[16th Embodiment]

Figure 23:
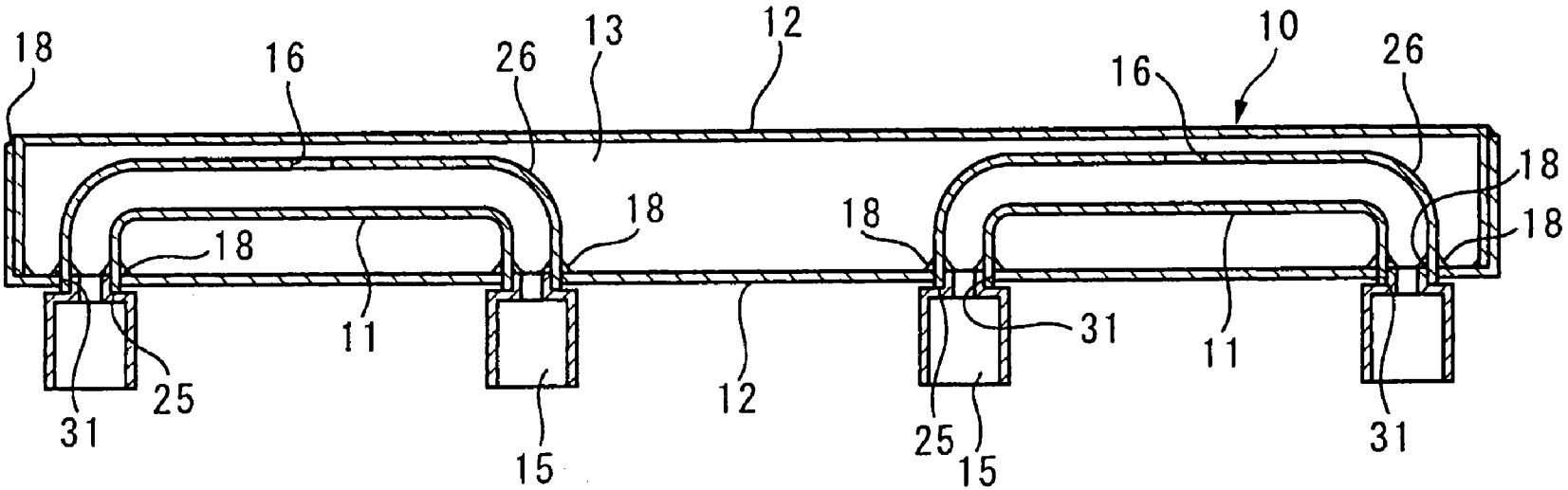
FIG. 23 is a cross-sectional view, taken in the parallel direction to the pipe axis of the tubular joint, of the connecting portion between the fuel delivery pipe body and the tubular joint in a 16th embodiment.

Next, a description will be given of a sixteenth embodiment with reference to FIG. 23. Although in the above-described first to 14th embodiments the tubular joint 11 is fixed to the outer surface of the fuel delivery pipe body 10, in this 16th embodiment a combination box type made by sheet metal pressing is adopted. The tubular joint 11 is inserted and disposed inside the fuel delivery pipe body 10 in which the upper or lower wall 12 is used as the absorbing wall surface, thereby making it possible to make the fuel delivery pipe compact and improve the layout feature at the time of installation in the vehicle body. In the 16th embodiment, the tubular joint 11, which is formed in a U-shape in a side view by providing the substantially orthogonally bent portion 26 on each pipe end portion 25 side, is inserted and disposed inside the fuel delivery pipe body 10, and the inlet port 16 which is open in the center of the tubular joint 11 and the interior of the fuel delivery pipe body 10 are communicated, allowing the introduction of the fuel. In addition, both pipe end portions 25 of the tubular joint 11 are respectively caused to project to the outside from two projection holes 31 which are open in the upper or lower wall 12 of the fuel delivery pipe body 10, and the holder portions 15 of the injectors 32 are respectively provided on the projecting pipe end portions 25.

By the layout of such tubular joint 11 as well, the length of the fuel flow member 33 from the center of the inlet port 16 to the tip of the injector 32 can be made elongated. For this reason, it is possible to suppress the resonance of the fuel delivery pipe body 10 due to the pressure pulsation during fuel injection from the injector 32 consequent upon the adjustment to a low frequency in the air column vibration mode. Thus, it becomes possible to suppress the generation of the radiation noise from the fuel delivery pipe body 10 to a low level.

In addition, although in the above-described embodiments the cross-sectional shape of the fuel delivery pipe body 10 is made square or rectangular, the cross-sectional shape of the fuel delivery pipe body 10 may be formed in the shape of an ellipse, a triangle, a polygon including a pentagon or more, a key, a flask, a mortar, goggles, or the like. Preferably, the cross-sectional shape of the fuel delivery pipe body 10 may be formed in a shape having one or two absorbing wall surfaces. In addition, the fuel delivery pipe body 10 may be formed in the same shape from one end to the other, or a portion may be shaped differently. Furthermore, the wall surface of the fuel delivery pipe body 10 on the one hand, and the tubular joint 11, the bracket 20, the interposed member 22, the holder portion 15, the connection pipe 27, and the like on the other hand, may be fixed in a batch by welding or brazing.

What is claimed is:

1. A fuel delivery pipe, comprising:

a fuel delivery pipe body, a tubular joint, an injector, and a holder portion, wherein the tubular joint is provided with an inlet port communicating with the interior of the fuel delivery pipe body to introduce fuel made open in a center thereof having a smaller diameter than an inside diameter of the holder portion of the injector connected to both pipe end portions, a length from a center of the inlet port to the pipe end portion for connecting the holder portion of the injector is set to 30 to 1000 mm, to form the tubular joint, and the tubular joint and the fuel delivery pipe body are fixed such that the inlet port of the tubular joint is communicatable with the interior of the fuel delivery pipe body.

2. The fuel delivery pipe according to claim 1, wherein the fuel delivery pipe body has an outlet port for fuel which is open in the wall surface thereof, the tubular joint is disposed in contact with an outer surface of the fuel delivery pipe body in such a manner as to allow the outlet port and the inlet port of the tubular joint to communicate with each other, and an outer periphery of the communicating portion is fixed by welding or brazing.

3. The fuel delivery pipe according to claim 1, wherein the fuel delivery pipe body has an outlet port for fuel which is open in the wall surface thereof, the outlet port and the inlet port of the tubular joint are connected via a connection pipe provided on an outer surface of the fuel delivery pipe body, and an outer periphery of the communicating portion is fixed by welding or brazing.

4. The fuel delivery pipe according to claim 1, wherein the fuel delivery pipe body has the tubular joint inserted and disposed in the interior thereof so that the inlet port of the joint and the interior of the fuel delivery pipe body communicate with each other, both pipe end portions of the tubular joint are caused to project to the outside from projection holes opened in a wall surface of the fuel delivery pipe body, the holder portion of the injector is provided at each of the projecting portions, and an outer periphery of each of the projecting portions is fixed to the fuel delivery pipe body by welding or brazing.

5. The fuel delivery pipe according to claim 1, wherein the tubular joint is provided with one or a plurality of bent portions between the pipe end portion and the position where the inlet port is formed.

6. The fuel delivery pipe according to claim 2, wherein the fuel delivery pipe body includes a fixing member which is capable of suppressing the deformation of the fuel delivery pipe body and which is connected and fixed to the fuel delivery pipe body to straddle an outer surface of the tubular joint.

7. The fuel delivery pipe according to claim 2, wherein the fuel delivery pipe body and the tubular joint are fixed by welding or brazing with the interposition of an interposed member capable of suppressing the deformation of the fuel delivery pipe body, and the outlet port of the fuel delivery pipe body and the inlet port of the tubular joint are communicated through a through hole provided in the interposed member.

8. The fuel delivery pipe according to claim 7, wherein the interposed member is a bracket connected and fixed to an outer surface of the outlet port in the fuel delivery pipe body, a through hole is provided in the bracket in correspondence with the outlet port of the fuel delivery pipe body, the tubular joint is contacted with and fixed to the bracket by welding or brazing, and the outlet port of the fuel delivery pipe body and the inlet port of the tubular joint are communicated through the through hole provided in the bracket.

9. The fuel delivery pipe according to claim 2, wherein the connecting portion of the tubular joint for connection to the fuel delivery pipe body has a shape corresponding to that of the wall surface of the fuel delivery pipe body, and the tubular joint and the fuel delivery pipe body are connected by surface contact.

10. The fuel delivery pipe according to claim 1, wherein the tubular joint is formed integrally with the holder portion.

11. The fuel delivery pipe according to claim 1, wherein the tubular joint is formed separately from the holder portion.

* * * * *